US011696613B2

(12) United States Patent
Liao

(10) Patent No.: US 11,696,613 B2
(45) Date of Patent: Jul. 11, 2023

(54) HELMET WITH GEAR-CONSTRAINT TRANSFORMABLE CHIN GUARD STRUCTURE

(71) Applicant: JIANGMEN PENGCHENG HELMETS LTD., Heshan (CN)

(72) Inventor: Haotian Liao, Heshan (CN)

(73) Assignee: JIANGMEN PENGCHENG HELMETS LTD., Heshan (CN)

( * ) Notice: Subject to any disclaimer, the term of this patent is extended or adjusted under 35 U.S.C. 154(b) by 172 days.

(21) Appl. No.: 17/329,909

(22) Filed: May 25, 2021

(65) Prior Publication Data

US 2021/0274877 A1 Sep. 9, 2021

Related U.S. Application Data

(63) Continuation of application No. PCT/CN2019/113168, filed on Oct. 25, 2019.

(30) Foreign Application Priority Data

Mar. 4, 2019 (CN) ..... 201910160133.8

(51) Int. Cl.
*A42B 3/32* (2006.01)
*A42B 3/20* (2006.01)
*A42B 3/22* (2006.01)

(52) U.S. Cl.
CPC ..... *A42B 3/326* (2013.01); *A42B 3/205* (2013.01); *A42B 3/223* (2013.01)

(58) Field of Classification Search
CPC ..... A42B 3/326; A42B 3/205; A42B 3/223; A42B 1/06; A42B 3/00; A42B 3/04; A42B 3/20; A42B 3/32
See application file for complete search history.

(56) References Cited

U.S. PATENT DOCUMENTS 4,689,836 A * 9/1987 Vitaloni ..... A42B 3/222 2/9
10,143,259 B2 * 12/2018 Liao ..... A42B 3/326
(Continued)

FOREIGN PATENT DOCUMENTS

CN 1981659 A 6/2007
CN 101331994 A 12/2008
(Continued)

OTHER PUBLICATIONS

International Search Report and Written Opinion of the International Searching Authority issued by the China National Intellectual Property Administration, for corresponding International Patent Application No. PCT/CN2019/113168, dated Jan. 14, 2020, with an English translation.

(Continued)

*Primary Examiner* — Khaled Annis
(74) *Attorney, Agent, or Firm* — Myers, Wolin, LLC

(57) ABSTRACT

A helmet with a gear-constraint type transformable chin guard structure may include a shell body, a chin guard and two branches on the chin guard, wherein a supporting base, the branch, an inner gear, an outer gear and a drive member form an associated mechanism, the inner gear and the outer gear are rotatable about fixed axes and constitute a meshing constraint pair, the inner gear and the branch are in sliding fit with each other and constitute a sliding constraint pair, and the drive member transfer the motion of the outer gear to the branch and causes the chin guard to make an extension/retraction displacement relative to the shell body, such that the chin guard makes an turnover motion while also recombining a reciprocating motion, thereby realizing a transformation between a full-helmet position and a semi-helmet position.

21 Claims, 20 Drawing Sheets

(56) References Cited

U.S. PATENT DOCUMENTS

| | | | | |
|---|---|---|---|---|
| 11,241,061 | B2 * | 2/2022 | Liao | A42B 3/223 |
| 2002/0189005 | A1 * | 12/2002 | Taniuchi | A42B 3/223 2/424 |
| 2003/0182716 | A1 * | 10/2003 | Wu | A42B 3/326 2/424 |
| 2006/0080761 | A1 * | 4/2006 | Huh | A61F 9/06 2/10 |
| 2007/0074335 | A1 * | 4/2007 | Gafforio | A42B 3/223 2/410 |
| 2007/0124851 | A1 * | 6/2007 | Pyo | A42B 3/222 2/424 |
| 2007/0136934 | A1 | 6/2007 | Kim et al. | |
| 2008/0196148 | A1 * | 8/2008 | Morin | A42B 3/222 2/10 |
| 2008/0216215 | A1 * | 9/2008 | Lee | A42B 3/326 2/10 |
| 2011/0302701 | A1 * | 12/2011 | Kuo | A42B 3/326 2/424 |
| 2013/0191976 | A1 * | 8/2013 | Pizzi | A42B 3/223 2/424 |
| 2015/0264992 | A1 * | 9/2015 | Happel | A42B 3/04 2/422 |
| 2018/0027916 | A1 * | 2/2018 | Smallwood | A42B 3/223 |
| 2018/0103710 | A1 * | 4/2018 | Kim | A42B 3/326 |
| 2018/0213877 | A1 * | 8/2018 | Liao | A42B 3/225 |
| 2020/0029645 | A1 * | 1/2020 | Salvetti | A42B 3/222 |
| 2020/0037692 | A1 * | 2/2020 | Levesque | A42B 3/227 |
| 2020/0113268 | A1 * | 4/2020 | Liao | A42B 3/223 |
| 2020/0146387 | A1 * | 5/2020 | Nimura | A42B 3/205 |
| 2020/0178639 | A1 * | 6/2020 | Jwa | A42B 3/205 |
| 2020/0229529 | A1 * | 7/2020 | Hunt | A42B 3/223 |
| 2021/0274877 | A1 * | 9/2021 | Liao | A42B 3/326 |

FOREIGN PATENT DOCUMENTS

| | | | |
|---|---|---|---|
| CN | 101991208 | A | 3/2011 |
| CN | 105901820 | A | 8/2016 |
| DE | 20 2010 009 313 | U1 | 9/2010 |
| EP | 2 478 785 | A1 | 7/2012 |
| ES | 2 329 494 | | 11/2009 |
| ES | 2 625 394 | | 7/2017 |
| JP | 11-247019 | A | 9/1999 |
| WO | 2009/095420 | A1 | 8/2009 |

OTHER PUBLICATIONS

First Office Action with written opinion issued by the Spanish Patent Office for Spanish Patent Application No. 202190042, dated Sep. 29, 2022, with an English translation.

Examination Report No. 1 issued by IP Australia for Australian Patent Application No. 2019432494, dated Mar. 25, 2022.

Requisition by the Examiner in Accordance with Subsection 86(2) with Examination Search Report issued by the Canadian Intellectual Property Office for Canadian Patent Application No. 3,116,276, dated Sep. 13, 2022.

Extended European search report with the Supplementary European search report and the European search opinion issued by the European Patent Office for European Patent Application No. 19918461.5-1017, dated Feb. 3, 2022.

Examination Report issued by the Patent Office of India for Indian Patent Application No. 202127022838, dated Jun. 22, 2022, with an English translation.

Notification on Substantive Examination Result issued by the Ministry of Law and Human Rights Republic of Indonesia for Indonesian Patent Application No. HKI-3-KI.05.01.08-TA-P00202103785, dated Oct. 3, 2022, with an English translation.

Examination Report issued by the Portugal Patent Office for International Patent Application No. WO2020177342, dated Nov. 30, 2022, with an English translation.

Notice of Reasons for Refusal issued by the Japan Patent Office for Japanese Patent Application No. 2021-538147, dated Jun. 28, 2022, with an English translation.

Notice of Reasons for Refusal issued by the Korean Patent Office for Korean Patent Application No. 9-5-2022-079160014, dated Oct. 17, 2022, with an English translation.

* cited by examiner 2
1
12

1
12
2

12
1
2

2
12
1
2a(2b)
(01,03)

1
3a
(4,9b)
12
3b
2a(2b)
(01,03)

2

2
1
12

2
1
12

12
1
2

2
12
1
2a(2b)
(01,03)

1
3a
(4,9b)
12
3b
2a(2b)
(01,03)

2

2
B
B
7
1
12
6
03
A
A
01

2
6
B
12
1
A
03
A
7
01
B 7
6
12
2
1
B
B
03
01
A
A 6
7
2
1
12
A
B
B
A
(01,03)

1
7
6
B
12
B
2
(01,03)
2a
A
A

HELMET WITH GEAR-CONSTRAINT TRANSFORMABLE CHIN GUARD STRUCTURE

CROSS-REFERENCE

This application is a continuation application of international application PCT/CN2019/113168, filed Oct. 25, 2019 and designated the U.S., which claims priority to Chinese patent application No. 201910160133.8, filed Mar. 4, 2019. The contents of these applications are incorporated herein by reference in their entirety.

TECHNICAL FIELD

The present disclosure belongs to the technical field of human body safety protection appliances, and relates to a helmet for protecting a head of a human body, particularly to a helmet with a chin guard protecting structure, and more particularly to a helmet enabling the position and posture of a chin guard to be changed between a full-helmet structure and a semi-helmet structure according to application requirements.

BACKGROUND

It is well-known that users of various motor vehicles, racing cars, racing boats, balance cars, aircrafts and even cycling bicycles should wear helmets to protect their heads during the driving process. In addition, for persons working in many special situations such as spraying workshops, firefighting, disaster relief, anti-terrorism and anti-riot, as well as in harsh environments such as mine exploration, coal mining and tunneling, they also need to wear helmets to protect their heads from various unexpected injuries. At present, there are mainly two types of helmets, namely a full-helmet type and a semi-helmet type, where the full-helmet type helmets are equipped with chin guards surrounding the user's chin, while the semi-helmet type helmets have no chin guards. For the full-helmet type helmets, they can better protect the wearer's head because of their chin guards; while for the semi-helmet type helmets, they provide better comfort in use since the wearer's mouth, nose and other organs are not constrained by the chin guard.

For the conventional full-helmet type helmets, the chin guard and the shell body are integrated, that is, the chin guard is fixed relative to the shell body. Undoubtedly, the conventional full-helmet type helmets of this integrated structure are firm and reliable, and therefore provide sufficient safety for wearers. However, on the other hand, the full-helmet type helmets of the integrated structure have the following disadvantages. Firstly, from the point of view of use, when the wearer needs to carry out activities such as drinking water, making a call or taking a rest, the wearer must take off the helmet to complete the corresponding action, and there is no doubt that the full-helmet type helmets of the integrated structure are inflexible and inconvenient. Secondly, from the point of view of production, the full-helmet type helmets of the integrated structure have the structural characteristics of large cavity and small opening, such that the mold is very complex and the production efficiency is low. This is the reason why the full-helmet type helmets of the integrated structure are high in manufacturing cost.

It is obvious that the conventional helmets of the integrated full-helmet structure cannot satisfy the requirements of safety, convenience, low cost and the like. In view of this, the development of a helmet which combines the advantages of the safety of the full-helmet structure and the convenience of the semi-helmet structure has naturally become the current goal for helmet researchers and manufacturers. In this context, the applicant of the present patent has proposed "helmet with transformable jaw protecting structure based on gear constraint" in Chinese Patent Application CN105901820A, which is characterized in that fixed inner gears of a cylindrical gear type are arranged on two sides of a helmet shell, two rotating outer gears of a cylindrical gear type are correspondingly fastened on two branches of the chin guard, and corresponding arc-shaped constraint slots are constituted on supporting bases fastened to the helmet shell. The rotating outer gears and the fixed inner gears are constrained by the constraint slots, such that the rotating outer gears and the fixed inner gears are meshed with each other to constitute a kinematic pair. Accordingly, the position and posture of the chin guard are constrained by a predetermined process, and the chin guard travels in a planned path between a full-helmet structure position and a semi-helmet structure position and can be inversely operated between the two positions. In other words, the chin guard can be lifted from the full-helmet structure position to the semi-helmet structure position as needed, and vice versa. In addition, since the chin guard and the shell body are not integrated, the mold for manufacturing the helmet becomes simpler, such that the manufacturing cost can be reduced and the production efficiency can be improved. It is obvious that the gear-constraint transformable chin guard structure scheme provided in this patent application can better satisfy the requirements of safety, convenience, low cost and the like, thereby promoting the advancement of the helmet technology.

However, although the helmet with a transformable chin guard structure proposed in Chinese Patent Application CN105901820A has obvious advantages, long arc-shaped constraint slots with the through character are needed to keep the meshing relationship between the rotating outer gears and the fixed inner gears and the rotating outer gears swing at a large rotation angle along with the chin guard, thus causing several disadvantages. Specifically: 1) there is a hidden danger in the reliability of the helmet due to the long arc-shaped constraint grooves, because the chin guard cannot completely cover the constraint grooves, that is, it is difficult for the branch body of the chin guard to effectively cover the long arc-shaped constraint slots with the through character, when the chin guard forms a face-uncovered helmet during a pose transform process of the chin guard, particularly at a certain intermediate position between the full-helmet structure and the semi-helmet structure (the helmet in this case is in a form of "quasi-semi-helmet structure helmet", which is convenient for the wearer to carry out activities such as water drinking, conversation and temporary ventilation and is particularly suitable for tunnel operations). As a result, an opportunity is created for foreign objects to enter the meshing kinematic pair constituted by the rotating outer gears and the fixed inner gears, and once this case occurs, the gear constraint pair is easily stuck. In other words, there are some hidden dangers in the reliability of the helmet when in use. 2) The existence of the long arc-shaped constraint slots with the through character results in large noise of the helmet, also because the chin guard is required to constitute the face-uncovered helmet in a state in which the chin guard is in an intermediate position between the full-helmet structure and the half-helmet structure during a pose transform process of the chin guard, thus the chin guard cannot completely cover the constraint grooves for the rider, such that the jangle, due to the external airflow through the external surface of the helmet, can be easily transmitted from the constraint slots with the through character into the interior of the helmet. Since these constraint grooves are just arranged near two ears of the wearer, the sound insulation effect or the comfort of the helmet is poor. 3) The arrangement and operation mode of the outer gears that rotate like a planet make the safety of the helmet be weakened to a certain extent because the outer gears move with the chin guard to exhibit a planet rotation behavior when the chin guard is changed in a structural position of the chin guard. It is not difficult to find that a large space area is swept, and it is obviously impossible to arrange fastening screws or other fastening structures in the space area range through which the outer gears rotate. In this case, the supporting bases with the long arc-shaped constraint grooves constituted therein are forcibly designed as thin-shell members with a large span. It is well-known that members of this structure are relatively small in intrinsic rigidity, which means that the helmet shell is relatively low in rigidity, that is, the safety of the helmet is weakened.

In conclusion, the helmet with transformable jaw protecting structure based on gear constraint can be transformed between the full-helmet position and the semi-helmet position, but the helmet has the disadvantages of poor reliability, comfort and safety. In summary, there is still room for further improvement of the existing helmets with a transformable chin guard structure.

SUMMARY

In view of the above problems in the existing helmets with transformable jaw protecting structure based on gear constraint, the embodiments of the present disclosure provide a helmet with a gear-constraint transformable chin guard structure. Compared with the existing gear-constraint transformable chin guard structure technology, in this helmet, by improving the structure arrangement and driving mode of a gear constraint mechanism, the accurate conversion of the position and posture of the chin guard between a full-helmet structure and a semi-helmet structure can be ensured, and the reliability, comfort and safety of the helmet can be further improved effectively.

The object of the embodiment of the disclosure is achieved in this way. A helmet with a gear-constraint transformable chin guard structure, comprising: a shell body; a chin guard; and two supporting bases, wherein the two supporting bases are arranged on two sides of the shell body, respectively, and the two supporting bases are fastened on the shell body or integrated with the shell body; wherein the chin guard is provided with two branches which are arranged on two sides of the shell body, respectively; wherein for each of the two supporting bases, an inner gear constrained by the supporting base and/or the shell body and an outer gear constrained by the supporting base and/or the shell body are provided; wherein the inner gear is rotatable about an axis of the inner gear, and the outer gear is rotatable about an axis of the outer gear; wherein the inner gear comprises a body or an attachment having a through slot, and a drive member running through the through slot is provided; wherein the supporting base, the branch, the inner gear, the outer gear and the drive member on a side of the shell body constitute an associated mechanism; wherein in the associated mechanism, the branch is arranged outside the through slot of the inner gear, the outer gear and the inner gear are meshed with each other to constitute a kinematic pair, and the inner gear is in sliding fit with the branch to constitute a slidable kinematic pair; wherein the drive member is connected to the outer gear at one end of the drive member, such that the drive member is able to be driven by the outer gear or the outer gear is able to be driven by the drive member; the drive member is connected to the branch at the other end of the drive member, such that the branch is able to be driven by the drive member or the drive member is able to be driven by the branch; and, wherein a driving and operation logic executed by the chin guard, the inner gear, the outer gear and the drive member in the associated mechanism comprises:

(a) the chin guard begins with an initial turnover action; then, the chin guard drives the inner gear to rotate by the branch; after that, the inner gear drives the outer gear by means of meshing between the inner gear and the outer gear; and then, the outer gear drives the branch to move by the drive member, and the branch is caused to make slidable displacement relative to the inner gear by a constraint between the inner gear and the branch of the slidable kinematic pair, such that the position and posture of the chin guard are correspondingly changed during a turnover process of the chin guard;

(b) the inner gear begins with an initial rotation action; then, the inner gear drives the chin guard to make a corresponding turnover motion by the slidable kinematic pair constituted by the inner gear and the branch; meanwhile, the inner gear drives the outer gear to rotate by means of the meshing between the inner gear and the outer gear, and the outer gear drives the branch to move by the drive member and the branch is caused to make slidable displacement relative to the inner gear by a constraint between the branch and the inner gear of the slidable kinematic pair, such that the position and posture of the chin guard are correspondingly changed during a turnover process of the chin guard; or (c) the outer gear begins with an initial rotation action; then, the outer gear drives the inner gear to rotate by means of the meshing relationship between the outer gear and the inner gear; after that, the inner gear drives the chin guard to make a corresponding turnover motion by the slidable kinematic pair constituted by the inner gear and the branch; and meanwhile, the outer gear drives the branch to move by the drive member and the branch is caused to make slidable displacement relative to the inner gear by a constraint between the branch and the inner gear of the slidable kinematic pair, such that the position and posture of the chin guard are correspondingly changed during a turnover process of the chin guard.

In one embodiment, in the associated mechanism, the kinematic pair constituted by the inner gear and the outer gear is a planar gear drive mechanism.

In one embodiment, in the associated mechanism, the inner gear and the outer gear are cylindrical gears; and, when the inner gear and the outer gear are meshed with each other, a pitch radius R of the inner gear and a pitch radius r of the outer gear satisfy a relationship: $R/r=2$.

In one embodiment, in the associated mechanism, the drive member comprises a revolution surface having a revolution axis, the revolution axis is always rotatable about an outer gear axis synchronously along with the outer gear, and the revolution axis is arranged parallel to the outer gear axis and intersects with a pitch circle of the outer gear.

In one embodiment, the revolution surface of the drive member is a cylindrical surface structure or a circular conical surface structure.

In one embodiment, the drive member is fastened to the outer gear or integrated with the outer gear, and the drive member is in rotatable fit with the branch; or the drive member is in rotatable fit with the outer gear, and the drive member is fastened to the branch or integrated with the branch; or the drive member is in rotatable fit with the outer gear, and the drive member is also in rotatable fit with the branch.

In one embodiment, a first anti-disengagement member capable of preventing axial endplay of the inner gear is arranged on the supporting base, the shell body and/or the outer gear; a second anti-disengagement member capable of preventing axial endplay of the outer gear is arranged on the inner gear, the supporting base and/or the shell body; and, a third anti-disengagement member capable of preventing axial loosening of the branch of the chin guard is arranged on the inner gear.

In one embodiment, at least one of gear teeth of the outer gear is designed as an abnormity gear tooth having a thickness greater than an average thickness of all effective gear teeth on the outer gear, and the drive member is only connect to the abnormity gear tooth.

In one embodiment, the through slot of the inner gear is a flat straight through slot which is arranged to point to or pass through an inner gear axis; the slidable kinematic pair constituted by slidable fitting of the inner gear with the branch is a linear slidable kinematic pair, and the linear slidable kinematic pair is arranged to point to or pass through the inner gear axis; and, the straight through slot and the linear slidable kinematic pair are overlapped with each other or parallel to each other.

In one embodiment, when the chin guard is at a full-helmet structure position, the revolution axis of the revolution surface of the drive member in at least one associated mechanism is overlapped with the inner gear axis, and linear constraint elements comprised in the slidable kinematic pair in the associated mechanism are perpendicular to a plane constituted by the inner gear axis and the outer gear axis.

In one embodiment, a central angle $\alpha$ covered by all effective gear teeth on the inner gear is greater than or equal to 180 degrees.

In one embodiment, a first clamping structure is arranged on the supporting base and/or the shell body; at least one second clamping structure is arranged on the body of the inner gear or an extension of the inner gear; an acting spring for pressing and driving the first clamping structure close to the second clamping structure is further arranged on the supporting base and/or the shell body; the first clamping structure and the second clamping structure are male and female catching structures matched with each other; and, when the first clamping structure and the second clamping structure are clamp-fitted with each other, an effect of clamping and keeping the chin guard at a present position and posture of the chin guard is able to be achieved.

In one embodiment, the first clamping structure is in a convex tooth configuration; the second clamping structure is in a groove configuration; at least one second clamping structures is provided, wherein a second clamping structure is clamp-fitted with the first clamping structure when the chin guard is at a full-helmet structure position and another second clamping structure is clamp-fitted with the first clamping structure when the chin guard is at a semi-helmet structure position.

In one embodiment, another second clamping structure is clamp-fitted with the first clamping structure when the chin guard is at a face-uncovered structure position.

In one embodiment, the shell body comprises a booster spring arranging on the supporting base and/or the shell body; when the chin guard is at the full-helmet structure position, the booster spring is compressed and stores energy; when the chin guard turns over from the full-helmet structure position to a dome of the shell body, the booster spring releases the elastic force to aid in opening the chin guard; and, when the chin guard is located between the full-helmet structure position and the face-uncovered structure position, the booster spring stops acting on the chin guard.

In one embodiment, in at least one associated mechanism, a ratio of an inner-gear full-circumference equivalent teeth number ZR of meshing elements comprised in the inner gear to an outer-gear full-circumference equivalent teeth number Zr of meshing elements comprised in the outer gear satisfies a relationship: $ZR/Zr=2$.

In one embodiment, the outer gear in at least one associated mechanism comprises a web plate arranging on the outer gear.

In one embodiment, in at least one associated mechanism, the inner gear comprises a through slot constituted in the inner gear, the through slot participates in the slidable constraint behavior of the inner gear and the branch, and the slidable constraint behavior constitutes a part or all of the slidable kinematic pair constituted by the inner gear and the branch.

In one embodiment, the helmet further comprising a visor, wherein the visor comprises two legs arranged on two sides of the shell body, respectively, and capable of swinging around a fixed axis relative to the shell body; a load-bearing rail side is arranged on at least one of the legs, and the leg with the load-bearing rail side is arranged between the supporting base and the shell body; a through opening is constituted in an inner supporting plate on the supporting base facing the shell body, and a trigger pin extending out of the opening and capable of coming into contact with the load-bearing rail side of the leg is arranged on the outer gear; and, when the visor is in a fully buckled state, the arrangement of the trigger pin and the load-bearing rail side satisfies several conditions: when the chin guard is opened from the full-helmet structure position, the trigger pin is able to come into contact with the load-bearing rail side on the leg and thereby drive the visor to turn over; and when the chin guard returns to the full-helmet structure position from the semi-helmet structure position, during the first two-thirds of the return trip of the chin guard, the trigger pin is able to come into contact with the load-bearing rail side on the leg and thereby drive the visor to turn over.

In one embodiment, serrated first locking teeth are arranged on the legs of the visor, and second locking teeth corresponding to the first locking teeth are arranged on the supporting base and/or the shell body; a locking spring is arranged on the supporting base and/or the shell body; the first locking teeth move synchronously with the visor, and the second locking teeth is able to move or swing relative to the shell body; when the visor is in a buckled state, the second locking teeth is able to move close to the first locking teeth under the action of the locking spring, such that the visor is weakly locked; and, when the visor is opened by an external force, the first locking teeth is able to forcibly drive the second locking teeth to compress the locking spring to displace and thereby give way to the first locking teeth and unlock the first locking teeth.

In the helmet with a gear-constraint transformable chin guard structure according to the embodiments of the present disclosure, by adopting the arrangement mode of forming an associated mechanism by the chin guard, the inner gear, the outer gear and the drive member, the inner gear and the outer gear are allowed to rotate about a fixed axis and meshed with each other to constitute a kinematic pair, and a constraint pair in sliding fit with the branch of the chin guard is constituted on the inner gear, such that the branch, the inner gear and the outer gear can be driven to be rotatable. Meanwhile, the branch is driven to produce a reciprocating motion displacement relative to the inner gear by the drive member connected to the outer gear and the branch of the chin guard, such that the position and posture of the chin guard can be accurately changed along with the action of opening or closing the chin guard. Accordingly, the transformation of the chin guard between the full-helmet structure position and the semi-helmet structure position is realized, and the uniqueness and reversibility of the geometric motion trajectory of the chin guard can be maintained. Based on the arrangement mode and operation mode of the associated mechanism, during the pose transform process of the chin guard, the body of the branch of the chin guard can be synchronously rotated with the inner gear, so as to basically or even completely cover the through slot of the inner gear. Thus, external foreign objects can be prevented from entering the constraint pair, and the reliability of the helmet when in use is ensured. Moreover, the path of external noise entering the interior of the helmet can be blocked, and the comfort of the helmet when in use is improved. Meanwhile, since the operation space occupied by the outer gear that rotates about a fixed axis is relatively small, a more flexible arrangement choice is provided for the fastening structure of the supporting bases, the support rigidity of the supporting bases can be improved, and the overall safety of the helmet can be further improved.

DETAILED DESCRIPTION OF THE EMBODIMENTS

The present disclosure will be further described below by specific embodiments with reference to FIGS. 1 through 36D.

Figure 1:
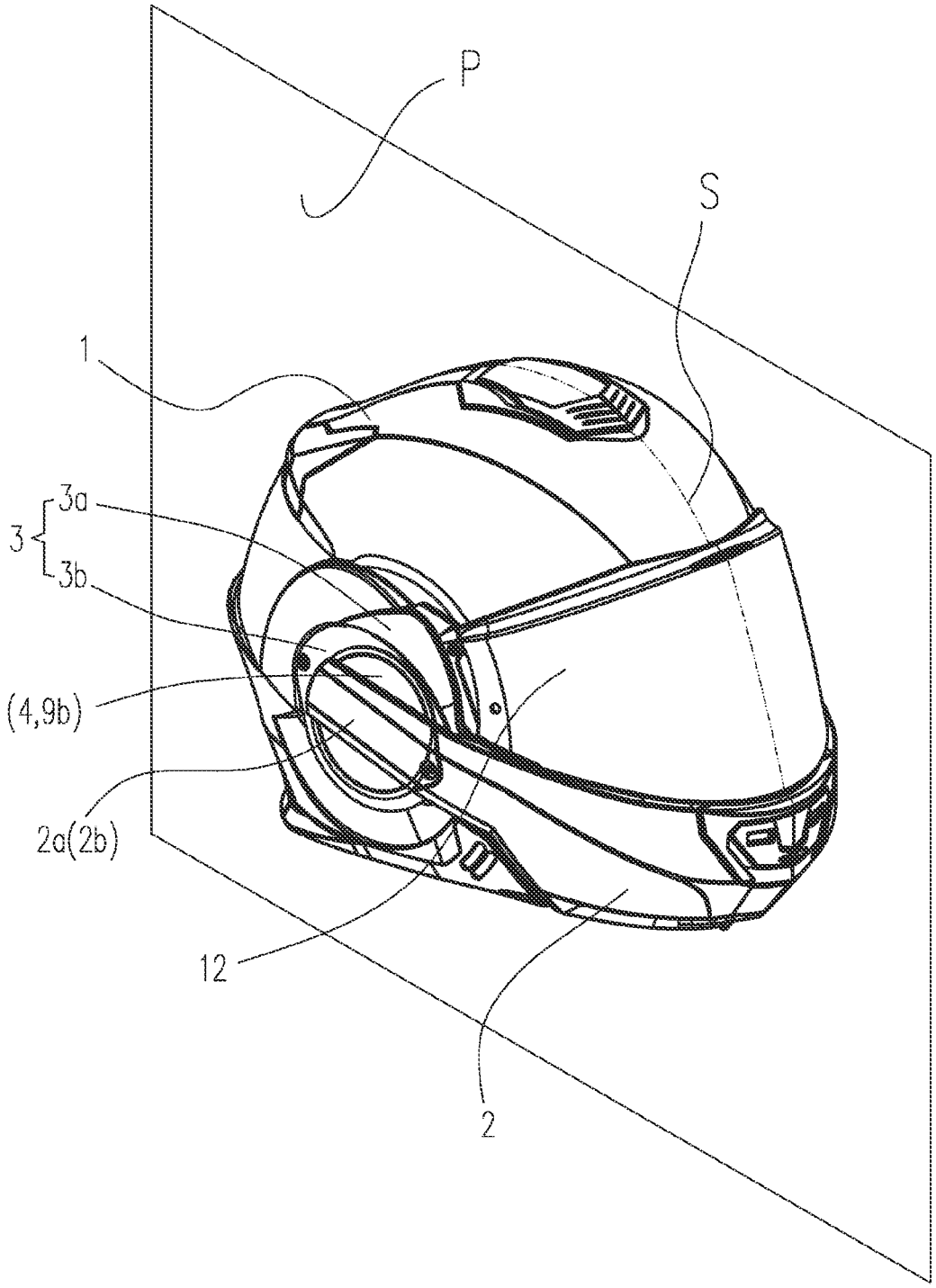
FIG. 1 is an axonometric view of a helmet with a gear-constraint transformable chin guard structure according to an embodiment of the present disclosure.
Figure 2:
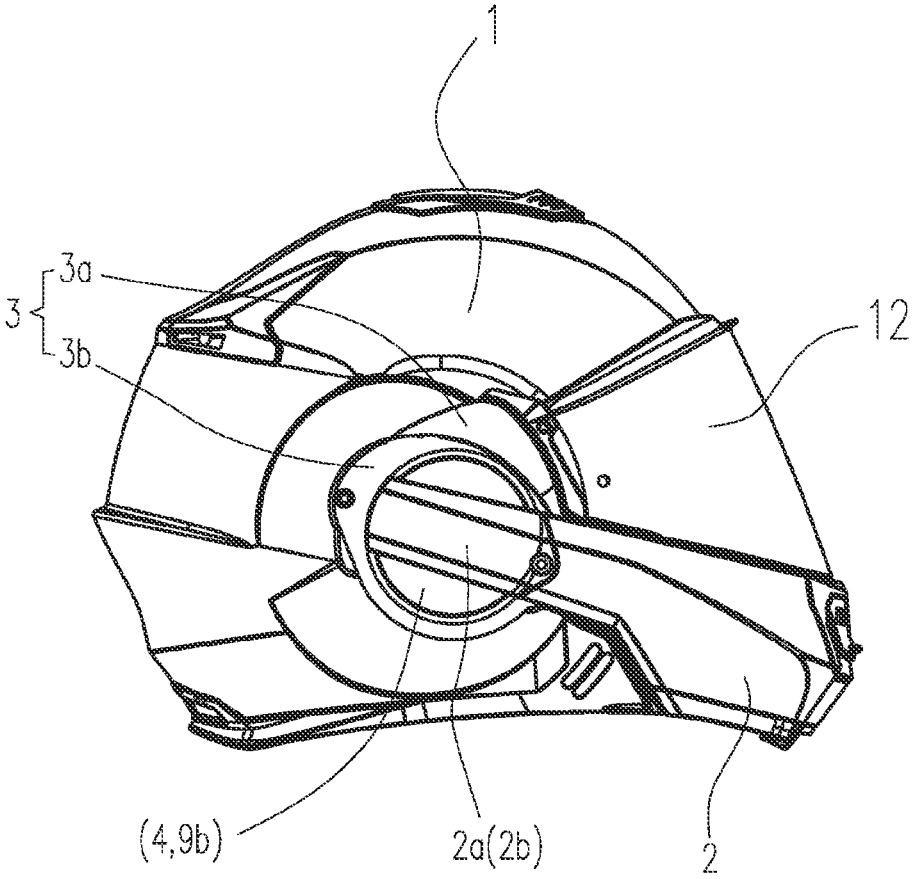
FIG. 2 is a side view when the helmet with the gear-constraint transformable chin guard structure in FIG. 1 is in a full-helmet structure state.
Figure 3:
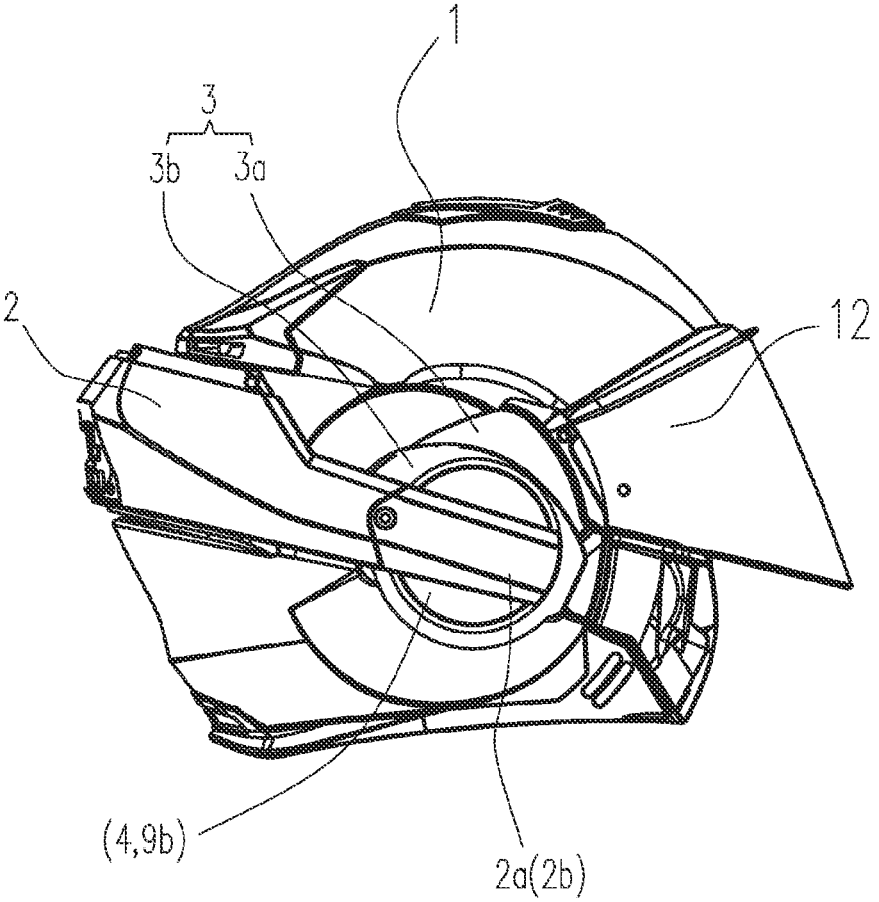
FIG. 3 is a side view when the helmet with the gear-constraint transformable chin guard structure in FIG. 1 is in a semi-helmet structure state.
Figure 4:
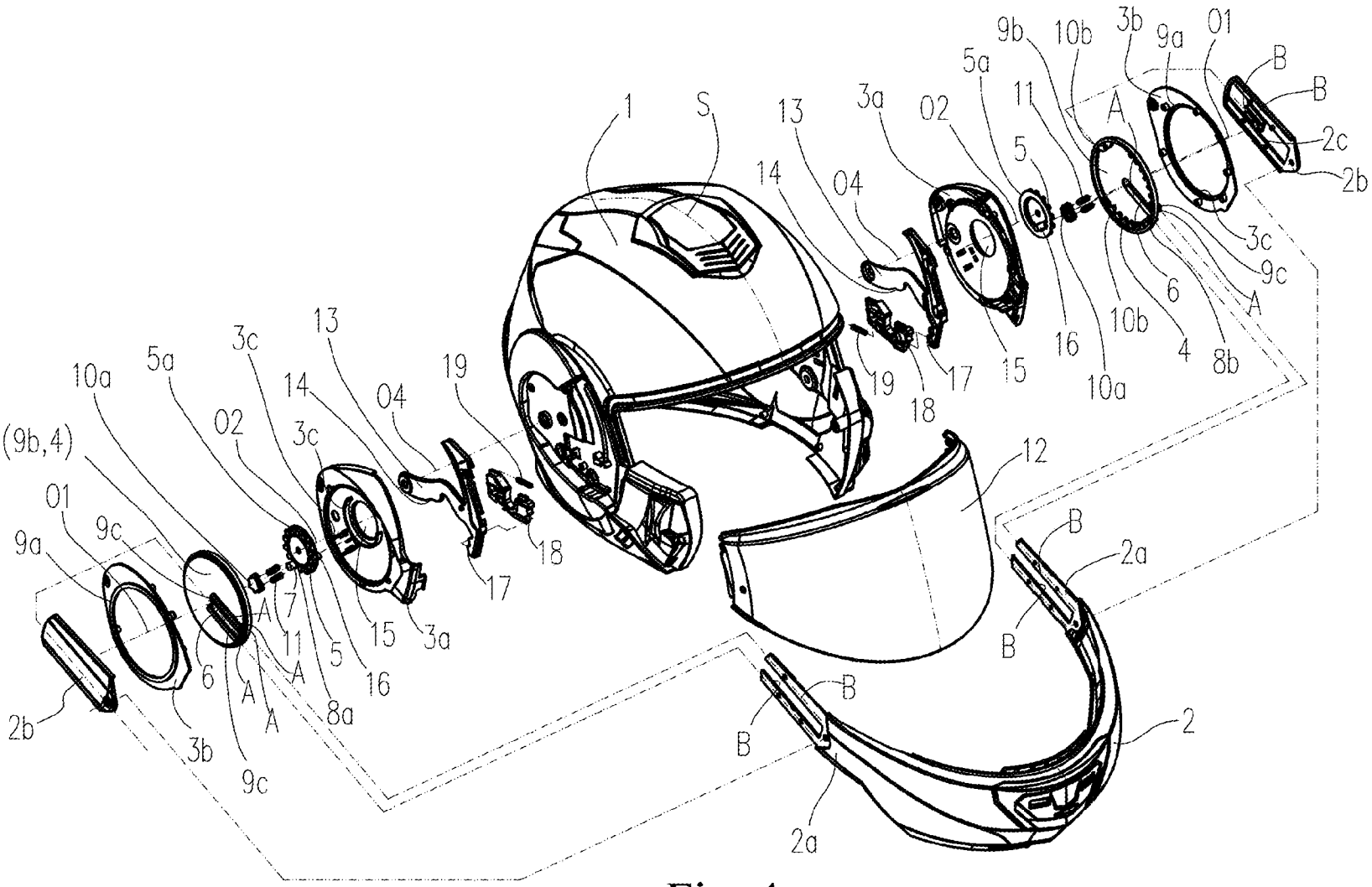
FIG. 4 is an exploded view showing assembly of the helmet with the gear-constraint transformable chin guard structure in FIG. 1.
Figures 5A, 5B, 5C, 5D, 5E:
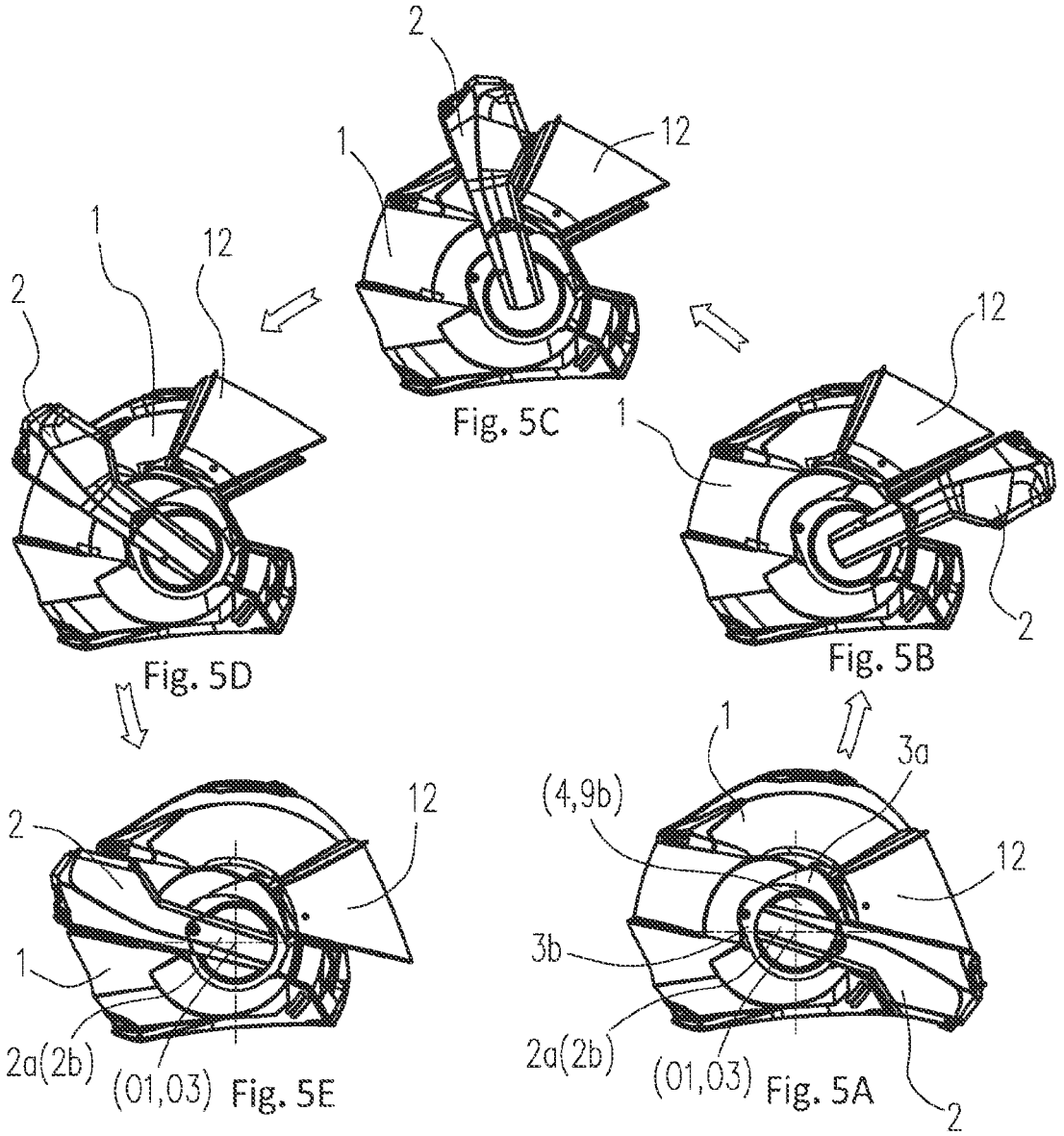
FIGS. 5A through 5E are schematic diagrams showing state of a process of changing a chin guard from a full-helmet structure position to a semi-helmet structure position in the helmet with the gear-constraint transformable chin guard structure according to an embodiment of the present disclosure.
Figures 6A, 6B, 6C, 6D, 6E:
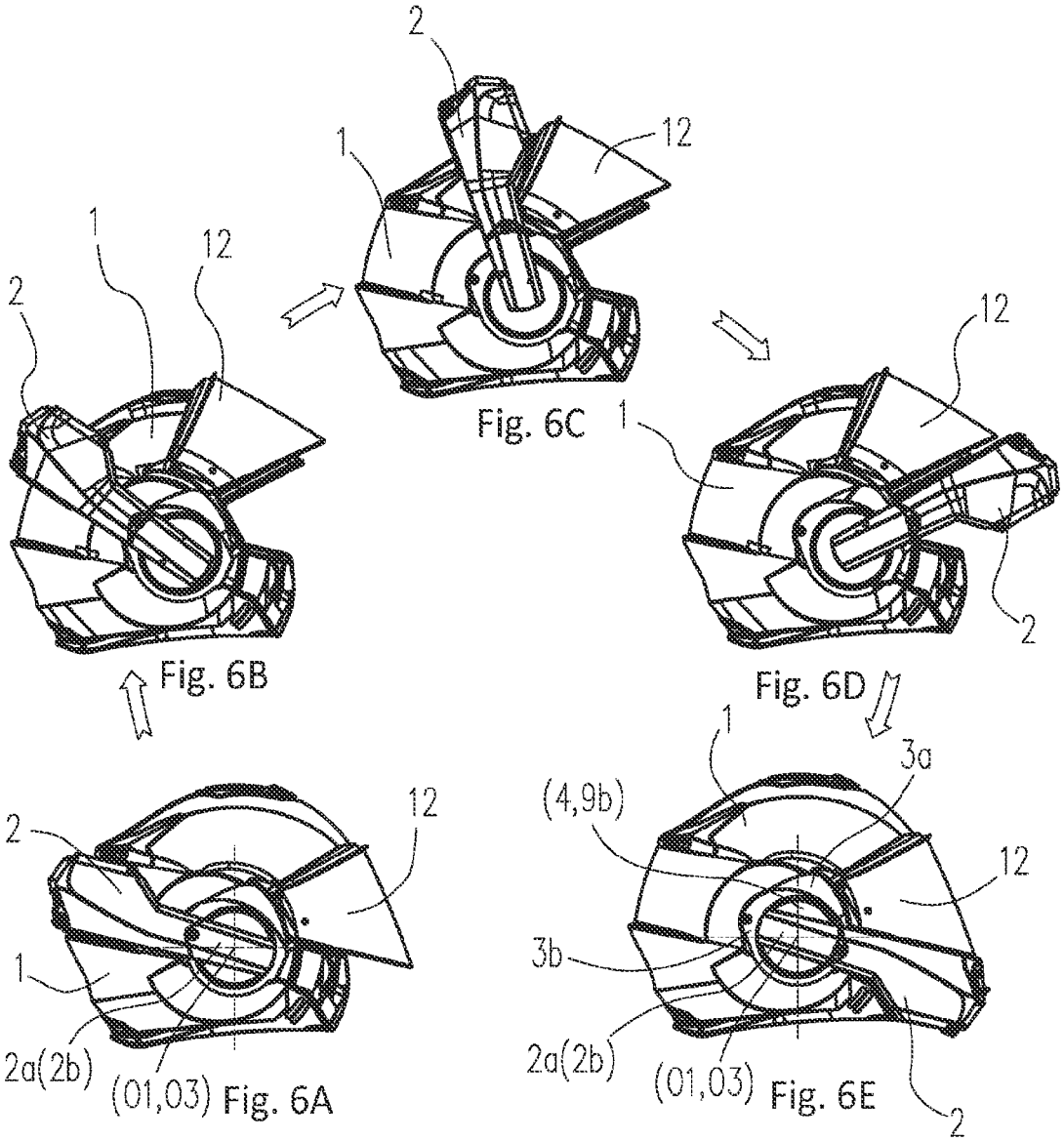
FIGS. 6A through 6E are schematic diagrams showing state of a process of returning the chin guard from the semi-helmet structure position to the full-helmet structure position in the helmet with the gear-constraint transformable chin guard structure according to an embodiment of the present disclosure.
Figure 7:
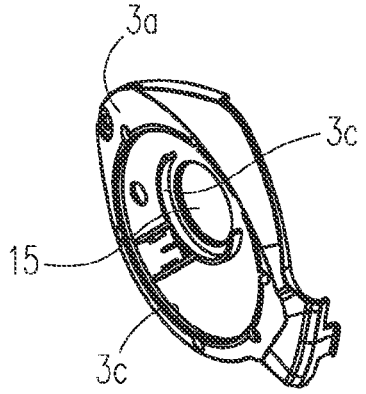
FIG. 7 is an axonometric diagram of an embodiment of an inner supporting plate of a supporting base in the helmet with the gear-constraint transformable chin guard structure according to an embodiment of the present disclosure.
Figure 8:
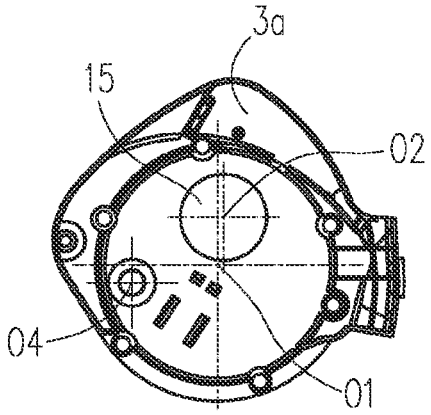
FIG. 8 is a radial diagram of the inner supporting plate in FIG. 7 when viewed in a direction from a shell body inside the helmet to the outside of the helmet along the inner gear axis.
Figure 9:
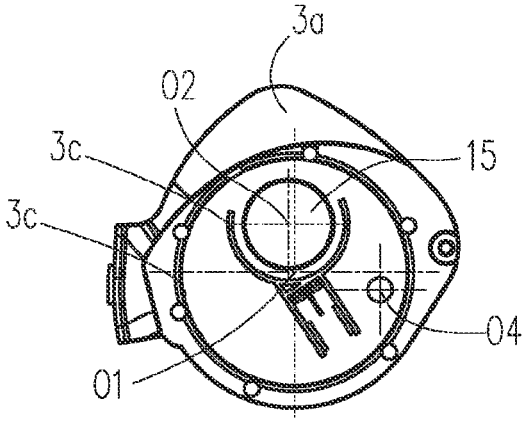
FIG. 9 is a radial diagram of the inner supporting plate in FIG. 7 when viewed in a direction from the outside of the helmet to the shell body of the helmet along the inner gear axis.
Figure 10:
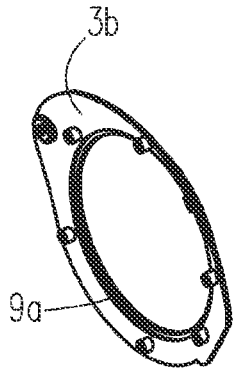
FIG. 10 is an axonometric diagram of an embodiment of an outer supporting plate of a supporting base in the helmet with the gear-constraint transformable chin guard structure.
Figure 11:
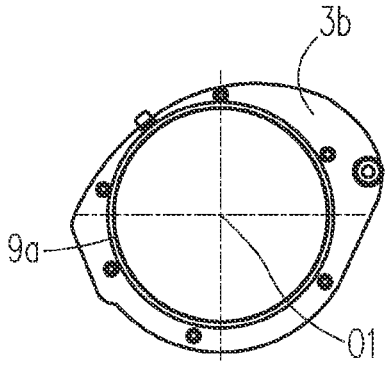
FIG. 11 is a radial diagram of the outer supporting plate in FIG. 10 when viewed in a direction from the shell body inside the helmet to the outside of the helmet along the inner gear axis.
Figure 12:
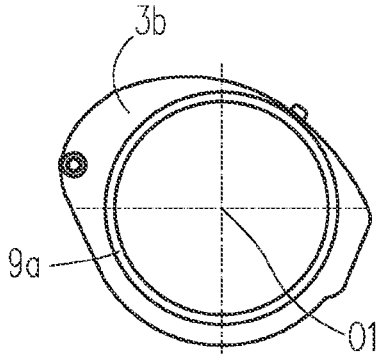
FIG. 12 is a radial diagram of the outer supporting plate in FIG. 10 when viewed in a direction from the outside of the helmet to the shell body of the helmet along the inner gear axis.
Figure 13:
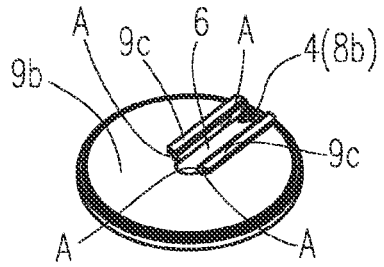
FIG. 13 is an axonometric view of the inner gear in the helmet with the gear-constraint transformable chin guard structure according to an embodiment of the present disclosure.
Figure 23:
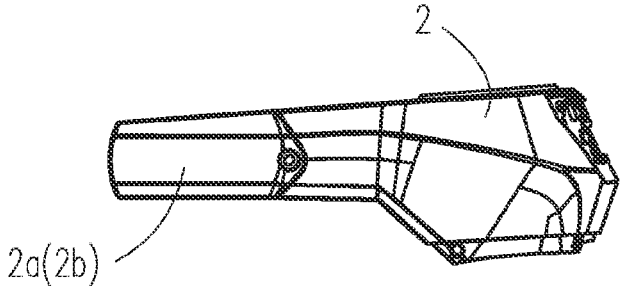
FIG. 23 is a side view of the chin guard and branches thereof in FIGS. 21 and 22 when fitted with a buckle cover.
Figure 27:
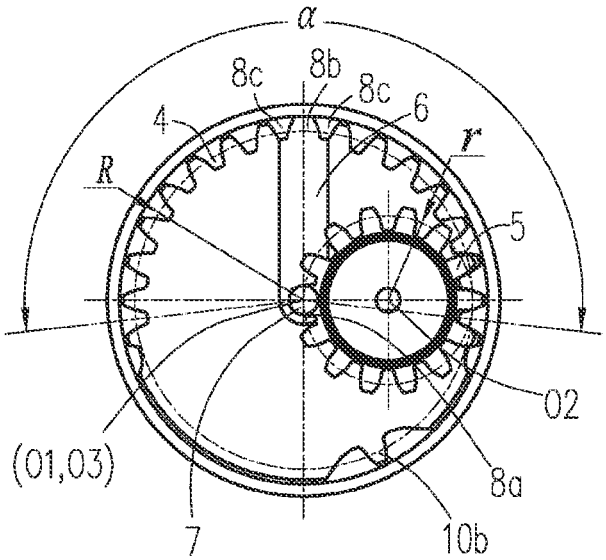
FIG. 27 is a schematic diagram showing meshing between the inner gear and the outer gear when a ratio of a pitch radius R of the inner gear to a pitch radius r of the outer gear is designed as 2:1 in the helmet with the gear-constraint transformable chin guard structure according to an embodiment of the present disclosure.
Figure 28A:
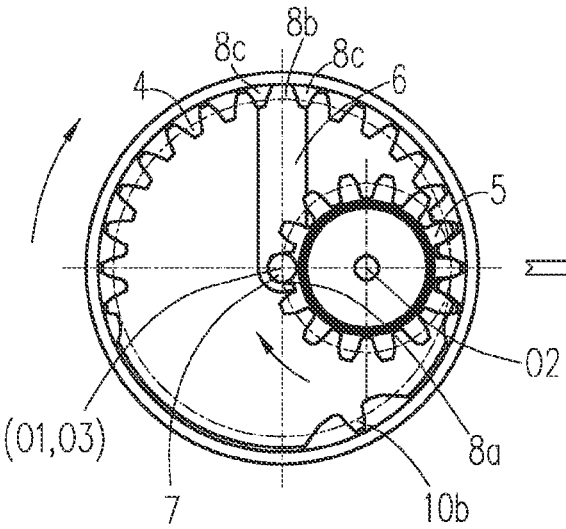
FIGS. 28A through 28B are schematic diagrams showing state changes of the inner gear and the outer gear according to an embodiment of the present disclosure, where the ratio of the pitch radius R of the inner gear to the pitch radius r of the outer gear is designed as 2:1, a through slot of the inner gear is straight and the through slot is rotated to a certain position from an initial position perpendicular to a plane constituted by the inner gear axis and the outer gear axis.
Figure 28B:
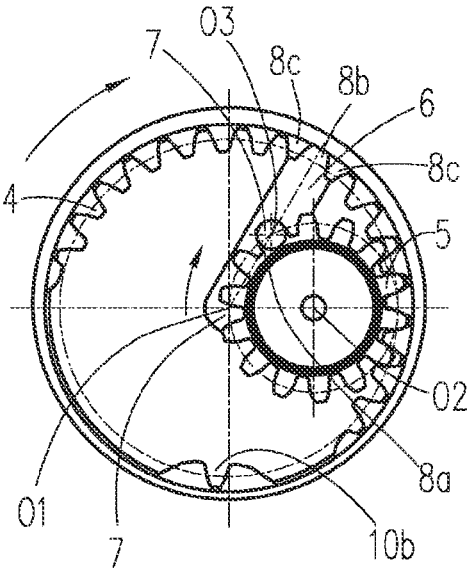

A helmet with a gear-constraint transformable chin guard structure is provided, including a shell body 1, a chin guard 2 and two supporting bases 3. The two supporting bases 3 are arranged on two sides of the shell body 1, respectively. The two supporting bases 3 are fastened on the shell body 1 (as shown in FIGS. 1 and 4), or are integrated with the shell body 1 (not shown). Here, in the embodiments of the present disclosure, the connection between the two supporting bases 3 and the shell body 1 includes, but is not limited to four situations: 1) the two supporting bases 3 are independent parts and are fastened on the shell body 1 (as shown in FIGS. 1 through 4); 2) the two supporting bases 3 are completely integrated with the shell body 1 (not shown); 3) a portion of each of the two supporting bases 3 is integrated with the shell body 1, while the rest portion of each of the two supporting bases 3 is constructed as an independent member (not shown); and 4) one of the two supporting bases 3 is fastened on the shell body 1, while the other one of the two supporting bases 3 is integrated with the shell body 1 (not shown). In addition, by "the two supporting bases 3 are arranged on two sides of the shell body 1, respectively" in the embodiments of the present disclosure, it is meant that the two supporting bases 3 are arranged on two sides of a symmetry plane P of the shell body 1, where the symmetry plane P passes through the wearer's mouth, nose and head and separates the wearer's eyes, ears and the like on two sides of the wearer when the wearer normally wears the helmet, that is, the symmetry plane P is actually an imaginary plane that halves the shell body 1 (as shown in FIG. 1). In other words, the symmetry plane P in the embodiments of the present disclosure may be regarded as a bilateral symmetry plane of the shell body 1. The symmetry plane P passing through the shell body 1 will have an intersection line S with a contoured outer surface of the shell body 1 (see FIGS. 1 and 4). In the embodiments of the present disclosure, an optimal arrangement of the supporting bases 3 is that each of the two supporting bases 3 is arranged on one of the two sides of the shell body 1 near or proximal to the ear of the helmet wearer (as shown in FIGS. 1 through 4). In the embodiments of the present disclosure, the chin guard 2 has two branches 2*a* (see FIGS. 4 and 21), the two branches are arranged on two sides of the shell body 1 (as shown in FIG. 4), that is, the two branches 2*a* are arranged on two sides of the symmetry plane P of the shell body 1. Preferably, a portion of the body of each of the two branches 2*a* is arranged on or extended to one of the two sides of the shell body 1 near or proximal to the ear of the helmet wearer (as shown in FIGS. 1 through 4). Here, each of the two branches 2*a* may be the body of the chin guard 2 or an extension of the body of the chin guard 2. Particularly, the branches 2*a* may also be independent parts fastened or attached to the body of the chin guard 2 (including an extension or elongation of the body of the chin guard 2). In other words, in the embodiments of the present disclosure, the body of each of the two branches 2*a* includes not only a portion of the body of the chin guard 2 but also other parts fastened on the body of the chin guard 2. As shown in FIGS. 4 and 23, each of the two branches 2*a* consists of an extension of the body of the chin guard 2 and a buckle cover 2*b* fastened on the extension. Hence, according to the embodiments of the present disclosure, when each of the two branches 2*a* includes a buckle cover 2*b*, the branch 2*a* may also be denoted by 2*a* (2*b*) in the drawings. It is to be noted that, in the embodiments of the present disclosure, each of the two supporting base 3 may be a part assembled or combined by several parts (as shown in FIG. 4), or may be a part composed of a single member (not shown), wherein the supporting base 3 that combined by several parts is optimal because this supporting base 3 can be manufactured, mounted and maintained more flexibly. In the case shown in FIG. 4, each of the two supporting base 3 is a component combined by several parts. In the case shown in FIG. 4, each of the two supporting base 3 comprises an inner supporting plate 3*a* and an outer supporting plate 3*b*. In addition, in some drawings of the embodiments of the present disclosure, for example, in FIGS. 32A through 32C, the inner supporting plate 3*a* may be denoted by a supporting base 3 (3*a*), and the outer supporting plate 3*b* may be denoted by a supporting base 3 (3*b*). In addition, it is also to be noted that, in the embodiments of the present disclosure, the shell body 1 is a general term. The shell body 1 may be the shell body 1 itself, or may include various other parts fastened and attached to the shell body 1 as well as the shell body 1 itself. These parts include various functional parts or decorative parts such as an air window, a seal cover, a pendant, a sealing element, a fastener and an energy absorbing element. The embodiments of the present disclosure are characterized in that: for each of the two supporting base 3, an inner gear 4 constrained by the supporting base 3 or/and the shell body 1 and an outer gear 5 constrained by the supporting base 3 or/and the shell body 1 are correspondingly provided (see FIGS. 4, 13 through 20). The inner gear 4 is rotatable about the inner gear axis O1 of the inner gear 4, and the outer gear 5 is rotatable about an outer gear axis O2 of the outer gear 5 (see FIGS. 28A through 28B and 29A through 29B). Here, in the embodiments of the present disclosure, the inner gear 4 and the outer gear 5 are meshed with each other, the inner gear 4 is an inner-toothed gear, and the outer gear 5 is an outer-toothed gear. Therefore, in the embodiments of the present disclosure, the meshing of the inner gear 4 with the outer gear 5 belongs to the gear transmission of an inner meshing property. It is worth mentioning that the inner gear 4 and the outer gear 5 in the embodiments of the present disclosure may be cylindrical gears (as shown in FIGS. 4, 14, 16 through 19, 27 and 28A through 28B) or non-cylindrical gears (not shown). It is preferable that the inner gear 4 and the outer gear 5 are cylindrical gears. When the inner gear 4 and the outer gear 5 are cylindrical gears, the inner gear axis O1 is an axis passing through a center of a reference circle of the inner gear 4, and the outer gear axis O2 is an axis passing through a center of a reference circle of the outer gear 5. Here, the center of the reference circle of the inner gear 4 coincides with a center of a pitch circle of the inner gear 4, and the center of the reference circle of the outer gear 5 coincides with a center of a pitch circle of the outer gear 5. In the embodiments of the present disclosure, particularly in a preferred arrangement situation, the inner gear axis O1 and the outer gear axis O2 are parallel to each other and perpendicular to the symmetry plane P of the shell body 1. It is to be noted that, in the embodiments of the present disclosure, the fixed-axis rotation of the inner gear 4 and the outer gear 5 may be generated under the constraint of the supporting base 3 or/and the shell body 1, or may be generated under the constraint of the supporting base 3 or/and the shell body 1 in combination with other constraints. For example, in the case shown in FIG. 4, the outer gear 5 is rotatable in the constraint of the supporting base 3 or/and the shell body 1 as well as in the constraint of the meshing relationship between the inner gear 4 and the outer gear 5. The inner gear 4 and the outer gear 5 are not only encircled and constrained by borders 3*c* on the supporting base 3, but also constrained by the meshing action between this two gears (see FIGS. 4 and 32A through 32C). Therefore, in FIG. 4, the inner gear 4 and the outer gear 5 make fixed-axis rotation behaviors under the joint constraint of multiple parts. In fact, since the supporting base 3 in the embodiment shown in FIG. 4 has a border 3*c* encircling the inner gear 4 and a border 3*c* encircling the outer gear 5, these borders 3*c* encircle and constrain the constrained objects by more than 180 degrees, the inner gear 4 and the outer gear 5 can be constrained to make fixed-axis rotation behaviors only depending on the constraint of these borders 3*c*, and the fixed-axis rotation of the gears can be more stable and reliable under the constraint of the borders 3*c* in combination with the meshing action of this two gears. However, if the constrained object (i.e., the inner gear 4 or the outer gear 5) is encircled by the border 3*c* by no more than 180 degrees (not shown), it is obvious that the reliable fixed-axis rotation of the constrained object additionally requires the meshing constraint of the inner gear 4 and the outer gear 5 or the constraint of other members. Here, the borders 3*c* may be a part of the body of the supporting base 3 (as shown in FIGS. 4, 7 and 9, the borders 3*c* form a part of the body of the inner supporting plate 3*a* of the supporting base 3), or may be independent members fastened on the supporting base 3 (not shown). In addition, there may be one or more borders 3*c* for constraining a certain gear, and the shape of the border 3*c* may be set according to the specific structural arrangement. For example, in the cases shown in FIGS. 4, 7 and 9, the border 3*c* for constraining the inner gear 4 is an enclosed circular ring-shaped edge which is allowed to have some notches, while the border 3*c* for constraining the outer gear 5 is a semi-enclosed open circular arc-shaped edge which is also allowed to have some notches. Actually, in the embodiments of the present disclosure, in addition to the ring-shaped or arc-shaped configuration, the border 3*c* may be in the other configurations such as convex boss, convex key, convex column or lug, or may be in a continuous configuration or a discontinuous configuration. For example, if three contact points distributed in the form of an acute triangle (that is, the triangle formed by the three points when used as apexes is an acute triangle) are used as constraint members, the effect of the fixed-axis rotation behavior achieved by constraining using the three contact points is equivalent to the effect of the fixed-axis rotation behavior achieved by constraining using a ring-shaped edge that encircles the constrained object by more than 180 degrees. It should be noted that, in addition to that the inner gear 4 and the outer gear 5 may be constrained by the structure and construction of the borders 3*c*, in the embodiments of the present disclosure, the rotation behavior of the inner gear 4 and the outer gear 5 may be constrained by a shaft/hole structure or a shaft/sleeve structure that may be for example constituted on the supporting base 3, and the inner gear 4 and the outer gear 5 may be constrained to be rotatable by means of the shaft/hole structure or shaft/sleeve structure (the hole or sleeve may be of a complete structure or may be a non-complete structure having notches). Meanwhile, a shaft structure in rotatable fit with the hole or sleeve is constituted on the inner gear 4 or/and the outer gear 5 (not shown). In this way, fixed-axis constraint on the corresponding inner gear 4 or outer gear 5 can be realized, and the inner gear 4 and the outer gear 5 is rotatable even only depending on these constraints. Of course, the shaft arranged on the inner gear 4 must have an axis coinciding with the inner gear axis O1 and should be coaxial with the hole or sleeve constituted on the supporting base 3 that is matched with this shaft, and the shaft arranged on the outer gear 5 must have an axis coinciding with the outer gear axis O2 and should be coaxial with the hole or sleeve constituted on the supporting base 3 that is matched with this shaft. Similarly, it is also possible that a shaft structure is constituted on the supporting base 3 and a hole or sleeve structure is correspondingly constituted on the inner gear 4 or/and the outer gear 5 to match with the shaft structure (not shown). This will not be repeated here due to the similar principle. In the embodiments of the present disclosure, the meshing of the inner gear 4 with the outer gear 5 means that the inner gear 4 and the outer gear 5 are meshed with each other by a toothed structure or configuration and realize the delivery and transmission of motion and power based on the meshing. The effective gear teeth of the inner gear 4 or the outer gear 5 may be distributed over an entire circumference, that is, the effective gear teeth are distributed at 360 degrees (for example, in the cases shown in FIGS. 4, 17, 19, 27 and 28A through 28B, the outer gear 5 belongs to this situation); or, the effective gear teeth may not be distributed over an entire circumference, that is, the effective gear teeth are distributed in a reference circle having an arc length less than 360 degrees (for example, in the cases shown in FIGS. 4, 14, 16, 27 and 28A through 28B, the inner gear 4 belongs to this situation). The so-called effective gear teeth refer to gear teeth that actually participate in meshing (including teeth and tooth sockets, the hereinafter). In addition, the effective gear teeth of the inner gear 4 and the outer gear 5 in the embodiments of the present disclosure may be measured or evaluated by modulus. However, the size of the tooth form may not be measured and evaluated by modulus. When the effective gear teeth of the inner gear 4 and the outer gear 5 are measured by modulus or the size of the tooth form is evaluated by modulus (for example, when two meshing gears are involute gears), for gears that are paired and meshed (including teeth and tooth sockets), the moduli of the two gears are preferably equal. However, in a case where abnormity teeth/tooth sockets or modified teeth/tooth sockets are meshed, the moduli of the two gears may not be equal. It is to be noted that, even for a same gear, the modulus of all effective gear teeth of this gear is not necessarily required to be equal. For example, according to the embodiments of the present disclosure, individual or some abnormity gear teeth or abnormity tooth sockets are allowed in all effective gear teeth of the inner gear 4 (see the abnormity tooth socket 8*b* and modified gear teeth 8*c* in FIGS. 14, 16, 27 and 28A through 28B), and individual or some abnormity gear teeth or abnormity tooth sockets are allowed in all effective gear teeth of the outer gear 5 (see the abnormity gear tooth 8*a* in FIGS. 17 through 18, 27 and 28A through 28B). Alternatively, if it is observed or measured from the reference circle, the inner gear 4 and the outer gear 5 are allowed to exhibit different tooth thicknesses or different tooth socket widths. FIGS. 27 and 28A through 28B show a case where there are abnormity tooth sockets 8*b* on the inner gear 4 while there are abnormity gear teeth 8*a* on the outer gear 5, wherein the abnormity tooth sockets 8*b* on the inner gear 4 are present in the form of tooth sockets, and the abnormity gear teeth 8*a* on the outer gear 5 are present in the form of teeth; and, the abnormity gear teeth 8*a* on the outer gear 5 and the abnormity tooth sockets 8*b* on the inner gear 4 are mating constraint objects meshed with each other. In addition, in the case shown in FIGS. 27 and 28A through 28B, there are modified gear teeth 8*c* in the form of teeth on the inner gear 4. It is not difficult to find that the abnormity gear teeth 8*a* and the modified gear teeth 8*c* mentioned above are different from each other in shape and size and also different from other normal effective gear teeth in shape. In other words, if the shape and size of the abnormity gear teeth 8*a* and the modified gear teeth 8*c* may be measured by modulus, the moduli for the both will be different from each other, and the moduli for both are also different from the moduli for other normal effective gear teeth. It is also to be noted that, in the embodiments of the present disclosure, there is a particular case where individual or several non-gear meshing behaviors may occur in the process of meshing between the inner gear 4 and the outer gear 5, that is, some meshing forms of non-gear members having transitional properties, such as column/groove meshing, key/groove meshing or cam/recess meshing, are allowed to be provided in certain gaps, segments or processes of normal meshing of the inner gear 4 with the outer gear 5. The size of these non-gear meshing members may be or may not be evaluated by modulus. In other words, for the non-gear meshing, the size of the meshing structure may be measured in other non-modulus manners. It should be pointed out that the abnormity gear tooth 8*a*, the abnormity tooth socket 8*b* and the modified gear tooth 8*c* in the embodiments of the present disclosure may be conventional gear forms which are measured by modulus in shape or tooth socket size, or may be non-gear meshing members which are not measured by modulus in shape or tooth socket size. It should also be pointed out that, in the embodiments of the present disclosure, although the meshing of non-gear members is possible, the meshing of non-gear members is merely auxiliary transitional meshing, and the pose transform mechanism for guiding and constraining the chin guard 2 to change in telescopic positional displacement and swing angular posture is still constrained and realized mainly by the gear meshing, such that the properties and behaviors of the gear-constraint transformable chin guard structure in the embodiments of the present disclosure are not substantially changed. It should be particularly pointed out that, in the embodiments of the present disclosure, for the inner gear 4 and the outer gear 5 meshed with each other, the shape of the effective gear teeth includes shapes of various gear configurations in the prior art, for example, shapes obtained by various creation methods such as a generation method or a profiling method, as well as shapes obtained by various manufacturing methods such as mold manufacturing, wire cutting, spark manufacturing or three-dimensional forming. The shapes of gear teeth include, but not limited to involute tooth shape, cycloidal tooth shape, hyperbolic tooth shape or the like, among which the involute tooth shape is most preferable (the gears shown in FIGS. 4, 14, 16, 17 through 18, 27 and 28A through 28B have involute gear teeth). This is because the involute gears are low in manufacturing cost and easy to mount and debug. In addition, the involute gear teeth may be used for straight gears or bevel gears. In the embodiments of the present disclosure, a through slot 6 is constituted in the body of the inner gear 4 or an attachment of the inner gear 4. The through slot 6 may be constituted in the body of the inner gear 4 (as shown in FIGS. 4 and 13 through 16), or may be constituted in an attachment fixed to the inner gear 4 (not shown). The attachment is another part fastened on the inner gear 4. It is to be noted that, in the embodiments of the present disclosure, the through slot 6 has a penetrating-through property. That is, when the through slot 6 is observed in an axial direction of the inner gear axis O1, it can be found that the through slot 6 is of a through shape that can be seen through (see FIGS. 4, 13 through 16, 27, 28A through 28B and 30A through 30B). Here, the through slot 6 may be in various shapes (i.e., the shape viewed in the axial direction of the inner gear axis O1), wherein the through slot 6 in the shape of a strip, particularly in the shape of a straight strip, is most preferable (as shown in FIGS. 4, 13 through 16, 27, 28A through 28B and 30A through 30B). This is because the through slot 6 in the shape of a straight strip has the simplest structure, and occupies a small space, such that it is convenient to conceal, hide, occlude and cover the through slot 6. In addition, in the embodiments of the present disclosure, a drive member 7 running through the through slot 6 is further provided (see FIGS. 4 and 31A through 31E). The drive member 7 may be arranged between the outer gear 5 and the branch 2*a*, and can run through the body of the inner gear 4 or the attachment of the inner gear 4 to be linked with the outer gear 5 and the branch 2*a*, respectively. In the embodiments of the present disclosure, the supporting base 3, the branch 2*a*, the inner gear 4, the outer gear 5 and the drive member 7 on a side of the shell body 1 form an associated mechanism. That is, there is a structural assembly relationship, a trajectory constraint relationship, a position locking relationship, a kinematic coordination relationship, a power transfer relationship or the like among the parts constituting the associated mechanism. In addition, it is to be noted that, in the embodiments of the present disclosure, the drive member 7 includes or has at least two ends, that is, the drive member 7 has at least two ends that can be fitted with external parts. It is also to be noted that, in the embodiments of the present disclosure, the drive member 7 may be in the form of a single part or a combination of two or more parts. When the drive member 7 is a combination of parts, the parts can be in a combination form of immovable fitting, or a combination form of movable fitting, in particular, they can also be a combination form of relative rotation. In addition, in the embodiments of the present disclosure, the drive member 7 particularly has two situations: 1) the drive member 7 is fastened to the outer gear 5 (including a situation where the drive member 7 and the outer gear 5 are integrated; as shown in FIGS. 4 and 17 through 19); and, 2) the drive member 7 is fastened to the branch 2*a* (including a situation where the drive member 7 and the branch 2*a* are integrated, not shown). As described above, in the embodiments of the present disclosure, the branch 2*a* may be an integral part, i.e., a single body structure. In addition, the branch 2*a* may be a component assembled from several parts, i.e., a body structure with a combined configuration (as shown in FIGS. 4 and 23). In FIGS. 4 and 23, the branch 2*a* actually includes the body of the chin guard 2 (including an extension of the body), a buckle cover 2*b* fastened to the body and other parts. Therefore, the situation where the drive member 7 is fastened to the branch 2*a* includes a situation where the drive member 7 is directly fastened to the body of the branch 2*a* (i.e., fastened to the body of the chin guard 2 or the extension of the chin guard 2, not shown) and a situation where the drive member 7 is fastened to a constituent part of the branch 2*a* (not shown). In the embodiments of the present disclosure, in the associated mechanism, the branch 2*a* is arranged outside the through slot 6 in the inner gear 4, the outer gear 5 and the inner gear 4 are meshed with each other to constitute a kinematic pair, and the inner gear 4 is in sliding fit with the branch 2*a* to constitute a slidable kinematic pair. One end of the drive member 7 is connected to the outer gear 5, such that the drive member 7 can be driven by the outer gear 5 or the outer gear 5 can be driven by the drive member 7; and, the other end of the drive member 7 is connected to the branch 2*a*, such that the branch 2*a* can be driven by the drive member 7 or the drive member 7 can be driven by the branch 2*a*. Here, in the embodiments of the present disclosure, the kinematic pair constituted by the outer gear 5 and the inner gear 4 belongs to a gear constraint pair, and the kinematic pair constituted by the inner gear 4 and the branch 2*a* belongs to a slidable kinematic pair (the slidable kinematic pair may be grooved rails, guide rails or other types of slidable pairs). For convenience of description, in the embodiments of the present disclosure, the elements on the inner gear 4 that constitute the slidable kinematic pair may be collectively referred to as first slide rails A (see FIGS. 4, 13 through 16 and 31A through 31E), and the elements on the branch 2*a* that constitute the slidable kinematic pair may be collectively referred to as second slide rails B (see FIGS. 4, 21, 22 and 31A through 31E). The first slide rails A and the second slide rails B are slidingly fitted to constitute the slidable kinematic pairs (see FIG. 26), such that the purpose of constraining the inner gear 4 and the branch 2*a* to realize relative sliding is achieved. It is to be noted that, in the embodiments of the present disclosure, the slidable kinematic pair actually includes various grooved rail type slidable kinematic pairs and various guide rail type slidable kinematic pairs in the prior art, and there may be one or more grooved rails in the grooved rail type slidable kinematic pair or one or more guide rails in the guide rail type slidable kinematic pair. Particularly, in the embodiments of the present disclosure, the first slide rails A and the second slide rails B may be paired in one-to-one correspondence to constitute slidable kinematic pairs (that is, only one second slide rail B is in sliding fit with one first slide rail A, and only one first slide rail A is in sliding fit with one second slide rail B), or may not be paired in one-to-one correspondence to constitute slidable kinematic pairs (that is, each of the first slide rails A may be in sliding fit with a plurality of second slide rails B, or each of the second slide rails B may be in sliding fit with a plurality of first slide rails A). It should be emphasized that, in the embodiments of the present disclosure, the first slide rails A and the second slide rails B may be interchanged, that is, the first slide rails A and the second slide rails B may be interchanged in terms of structural and functional features. The constraint effects achieved by the kinematic constraint and trajectory constraint to the chin guard by the first slide rails A and the second slide rails B before and after interchange are comparative or equivalent. By taking the structural feature as an example, if the original first slide rail A appears in the form of a groove structure, the original second slide rail B appears in the form of a convex rail structure and the first slide rail A and the second slide rail B are matched with each other, the first slide rail A and the second slide rail B may be interchanged in structure, that is, the groove structure of the original first slide rail A is changed into a convex rail structure and the second slide rail B of the convex rail structure originally matched with the first slide rail A is changed into a groove structure, such that the slidable kinematic pairs constituted by the first slide rail A and the second slide rail B before and after interchange are equivalent. It is also to be noted that, in the embodiments of the present disclosure, the description "the branch 2*a* is arranged outside the through slot 6 in the inner gear 4" means that if the chin guard 2 is observed when placed at the full-helmet structure position or the semi-helmet structure position, and if the chin guard 2 travels from the outside towards the inside of the helmet (or to the shell body 1) along the inner gear axis O1, the chin guard 2 firstly encounters the body of the branch 2*a*, then reaches the through slot 6 in the inner gear 4 and finally reaches the shell body 1, that is, the branch 2*a* is located at an outer end farther away from the shell body 1 than the through slot 6. In the embodiments of the present disclosure, one advantage achieved by arranging the branch 2*a* outside the through slot 6 is that favorable conditions can be provided for the through slot 6 to be covered by the branch 2*a*. In the embodiments of the present disclosure, a driving and operation logic executed by the chin guard 2, the inner gear 4, the outer gear 5 and the drive member 7 in the associated mechanism (i.e., the inner gear 4, the outer gear 5 and the drive member 7 in the associated mechanism and the chin guard 2, four parts in total) at least includes one of three situations (a), (b) and (c): (a) The chin guard begins with an initial turnover action; then, the chin guard 2 drives the inner gear 4 by the branch 2*a*, such that the inner gear 4 rotates about an inner gear axis O1 of the inner gear 4; after that, the inner gear 4 drives the outer gear 5 by means of the meshing therebetween, such that the outer gear 5 rotates about an outer gear axis O2 of the outer gear 5; and then, the outer gear 5 drives the branch 2*b* by the drive member 7, such that the branch 2*a* moves and is driven to make slidable displacement relative to the inner gear 4 under the joint constraint of the slidable kinematic pair; and finally, the position and posture of the chin guard 2 are correspondingly changed during a turnover process of the chin guard 2; (b) The inner gear 4 begins with an initial rotation action about the inner gear axis O1; then, the inner gear 4 drives the chin guard 2 to make a corresponding turnover motion by the slidable kinematic pair constituted by the inner gear 4 and the branch 2*a* (here, a rotation force of the inner gear 4 will act on the slidable kinematic pair in the form of moment and the branch 2*a* is driven to rotate by the moment, so as to drive the chin guard 2 to make a corresponding turnover motion); meanwhile, the inner gear 4 drives the outer gear 5 by means of the meshing therebetween, such that the outer gear 5 rotates about an outer gear axis O2 of the outer gear 5; the outer gear 5 drives the branch 2*a* by the drive member 7, such that the branch 2*a* moves and is driven to make slidable displacement relative to the inner gear 4 under the joint constraint of the slidable kinematic pair; and finally, the position and posture of the chin guard 2 are correspondingly changed during a turnover process of the chin guard 2. (c) The outer gear 5 begins with an initial rotation action about the outer gear axis O2; then, the outer gear 5 drives the inner gear 4 to rotate about an inner gear axis O1 of the inner gear 4 by means of the meshing therebetween; after that, on one hand, the inner gear 4 drives the chin guard 2 to make a corresponding turnover motion by the slidable kinematic pair constituted by the inner gear 4 and the branch 2*a* (here, the inner gear 4 applies a moment to the slidable kinematic pair by means of rotation, and the branch 2*a* is driven by the moment to rotate so as to drive the chin guard 2 to make a corresponding turnover motion); on the other hand, the outer gear 5 drives the branch 2*a* by the drive member 7, such that the branch 2*a* moves and is driven to make slidable displacement relative to the inner gear 4 under the joint constraint of the slidable kinematic pair; and finally, the position and posture of the chin guard 2 are correspondingly changed during a turnover process of the chin guard 2. Here, the "turnover action" described in the embodiments of the present disclosure means that the chin guard 2 is turned by an angle relative to the shell body 1 during a movement the chin guard 2, particularly including but not limited to the movement process of the chin guard 2 from the full-helmet structure position to the semi-helmet structure position and the movement process from the semi-helmet structure position to the full-helmet structure position, the same hereinafter. In addition, the so-called "initial" described in the embodiments of the present disclosure means the mechanical or kinematic behavior of the first-activated part (or the part that is first driven by an external force) among the three parts, i.e., the chin guard 2, the inner gear 4 and the outer gear 5, the same hereinafter. In addition, in the embodiments of the present disclosure, the driving and operation logic executed by the chin guard 2, the inner gear 4, the outer gear 5 and the drive member 7 in the associated mechanism may be any one of the three situations (a), (b) and (c), or a combination of any two of the three situations (a), (b) and (c), or all of the three situations (a), (b) and (c). Particularly, any one, two or all of the three situations (a), (b) and (c) may be combined with other types of driving and operation logics. Among the driving and operation logics in the above situations, the driving and operation logic in the situation (a) is the most preferable in the embodiments of the present disclosure, because the driving and operation logic in the situation (a) is the simplest driving mode (in this case, the helmet wearer can accurately control the position and posture of the chin guard 2 by pulling the chin guard with his/her hand). The process of realizing driving and operation manually in the embodiments of the present disclosure will be detailed below by taking the situation (a) as an example. Firstly, the helmet wearer manually unlocks the chin guard 2 at the full-helmet structure position or the semi-helmet structure position or certain intermediate structure position (i.e., face-uncovered structure position). Secondly, the helmet wearer manually opens or buckles the chin guard 2 to make the chin guard 2 generate an initial turnover action. Then, the chin guard 2 drives the inner gear 4 to rotate about the inner gear axis O1 by the branch 2*a*. Next, the inner gear 4 drives the outer gear 5 to rotate about the outer gear axis O2 by means of the meshing therebetween. Subsequently, the outer gear 5 drives the branch 2*a* to move by the drive member 7, and the branch 2*a* is allowed to make slidable displacement relative to the inner gear 4 under the joint constraint of the slidable kinematic pair. Thus, the branch 2*a* makes an extension/retraction motion while rotating about the inner gear axis O1. Finally, the position and posture of the chin guard 2 are correspondingly changed during a turnover process of the chin guard 2. From the turnover process of the chin guard 2 illustrated in this embodiment, it is not difficult to find that the chin guard 2 can be extended/retracted in time during the process of opening the chin guard 2 by simply turning over the chin guard 2. The secret is the principle of gear meshing and the derivation of reciprocating movement by the drive member 7. Therefore, the complicated operation of simultaneously turning over, pulling and pressing the chin guard 2 in the conventional helmets with a transformable chin guard structure (see Chinese Patent Application ZL201010538198.0 and Spanish Patent Application ES2329494T3) can be greatly simplified. It is to be noted that, in the embodiments of the present disclosure, the slidable displacement of the branch 2*a* relative to the inner gear 4 is reciprocating telescopic. That is, in the embodiments of the present disclosure, the turnover motion of the chin guard 2 and branch 2*a* thereof is accompanied by the reciprocating motion relative to the inner gear 4 (it is equivalent that the chin guard 2 does a reciprocating motion relative to the shell body 1). In the embodiments of the present disclosure, just because of this characteristic, the position and posture of the chin guard 2 can be changed in time during the turnover process of the chin guard 2. As described above, in the embodiments of the present disclosure, the slidable kinematic pair constituted by the inner gear 4 and the branch 2*a* may be grooved rails, guide rails or other types of slidable pairs. That is, the slidable kinematic pair constituted by the inner gear 4 and the branch 2*a* may be various types of slidable pairs in the prior art, particularly including but not limited to, chute/slider, guide rod/guide sleeve, chute/guide pin, chute/slide rail or the like. In this case, it means that the branch 2*a* of the chin guard 2 is preferably attached to, abutted against or embedded in the inner gear 4, and a relative motion can be generated between the branch 2*a* and the inner gear 4. It is also to be noted that, in the embodiments of the present disclosure, the power for driving the chin guard 2 to make the initial turnover action, driving the inner gear 4 to make the initial rotation action or driving the outer gear 5 to make the initial rotation action may be derived from the driving of a motor, a spring, a human hand or the like. The driving power may be a single driving power or a combination of a plurality of driving powers. It is preferable that the driving force is generated by human hands, because this driving mode is the simplest and most reliable. In this case, the helmet wearer can directly pull the chin guard 2 with hands to turn over the chin guard 2, or directly pull the inner gear 4 with hands to rotate the inner gear 4, or directly pull the outer gear 5 with hands to rotate the outer gear 5. Furthermore, in addition to directly pulling the related parts with hands, the helmet wearer can indirectly drive the chin guard 2, the inner gear 4 or the outer gear 5 to make the corresponding motion by means of various linking members such as ropes, prod members or guide rods (not shown). Particularly, it is to be noted that, in the description "the inner gear 4 is rotatable about the inner gear axis O1 of the inner gear 4, and the outer gear 5 is rotatable about the outer gear axis O2 of the outer gear 5" in the embodiments of the present disclosure, the inner gear axis O1 and the outer gear axis O2 are not required to be in an absolute fixed-axis state and an absolute straight-axis state, and these axes are allowed to have certain deflection errors and deformation errors. That is, under various factors such as manufacturing error, mounting error, stress deformation, temperature deformation and vibration deformation, the inner gear axis O1 and the outer gear axis O2 are allowed to have deflection and distortion conditions such as offset, flutter, sway, swing and non-straightness within a certain error range. The error range described herein refers to an error magnitude which leads to a final comprehensive effect that does not affect the normal turnover process of the chin guard 2. There is no doubt that, in the embodiments of the present disclosure, the occurrence of non-parallel and non-straight inner gear axis O1 and outer gear axis O2 in a local area due to various factors, including but not limited to modeling need, obstacle-surmounting need and position locking need is allowed, wherein the "modeling need" means that the chin guard 2 is required to obey an overall appearance modeling of the helmet; the "obstacle-surmounting need" means that the chin guard 2 is required to surmount some limiting points such as the highest point, the backmost point and the widest point; and, the "position locking need" means that the chin guard 2 is required to be elastically deformed so as to stride across some clamping members at the full-helmet structure position, the semi-helmet structure position and the face-uncovered structure position as well as in the vicinity of these particular positions. All the non-parallel and non-straight phenomena of the inner gear axis O1 and the outer gear axis O2 (including the phenomenon that the inner gear axis O1 and the outer gear axis O2 are not perpendicular to the symmetry plane P of the shell body 1) due to the above reasons shall be regarded as being within the allowable error range in the embodiments of the present disclosure, as long as the normal turnover operation of the chin guard 2 is not affected. It is to be noted that, in the embodiments of the present disclosure, the "face-uncovered structure position" refers to any position between the full-helmet structure position and the semi-helmet structure position, where the helmet is in an intermediate state, also called a face-uncovered state (the helmet may be referred to as a face-uncovered helmet). The face-uncovered helmet is in a "quasi-semi-helmet structure" state. The chin guard 2 at the face-uncovered structure position may be in different structure position states, such as a slight opening degree, a medium opening degree and a high opening degree (where the opening degree is relative to the full-helmet structure position, and the chin guard 2 at the full-helmet structure position may be defined to be in a zero opening degree, i.e., not opened at all). The slight opening degree refers to a state where the chin guard 2 is slightly opened, and the slightly opened chin guard 2 is beneficial for ventilation and dispelling the breathing vapor in the helmet. The medium opening degree refers to a state where the chin guard 2 is opened to the vicinity of the wearer's forehead, and this state is beneficial for the wearer to perform activities such as communication and temporary rest. The high opening degree refers to a state where the chin guard 2 is located at or near the dome of the shell body 1, and this state is particularly suitable for the wearer to drink water, watch or take other work activities. It is to be noted that, in the embodiments of the present disclosure the chin guard 2 and branches 2*a* thereof obviously have an angular speed of rotation relative to the shell body 1 that is the same as the inner gear 4 in rotation direction and rotation speed. However, in this case, the chin guard 2 and branches 2*a* thereof are extended or retracted relative to the inner gear 4 during their synchronous rotations with the inner gear 4. It is to be noted that, the through slot 6 is constituted in the body of the inner gear 4 or an attachment of the inner gear 4, so the through slot 6 also rotates synchronously with the inner gear 4. In other words, in the embodiments of the present disclosure, the chin guard 2 and branches 2*a* thereof actually rotate synchronously with the through slot 6. In addition, it should be noted that, as described above, in the embodiments of the present disclosure, the branch 2*a* in the associated mechanism is arranged outside the through slot 6 in the inner gear 4. That is, in the embodiments of the present disclosure, on the outer side of the through slot 6, there is always a branch 2*a* that rotates synchronously with the through slot 6. It means that, in the embodiments of the present disclosure, during all turnover processes of opening or buckling the chin guard 2, the body of the branch 2*a* can be better designed to cover the through slot 6 (see FIGS. 5A through 5E and 6A through 6E). Particularly, it is to be noted that, in the embodiments of the present disclosure, the chin guard 2 and the body of the branch 2*a* rotate synchronously with the through slot 6, that is, the branch 2*a* and the through slot 6 have the same angular speed relative to the shell body 1. Therefore, in the embodiments of the present disclosure, the extension/retraction of the branch 2*a* relative to the inner gear 4 is actually performed along an opening direction of the through slot 6. It is to be noted that, in the embodiments of the present disclosure, the branch 2*a* is arranged outside the through slot 6. In other words, even if the branch 2*a* is designed to have a narrower body structure, the through slot 6 actually can be completely covered in a full-time and full-posture manner in the embodiments of the present disclosure, which is a significant difference between the gear-constraint transformable chin guard structure technology of the embodiments of the present disclosure and the existing gear-constraint transformable chin guard structure technologies such as CN105901820A, CN101331994A and WO2009095420A1. To more clearly illustrate the process of changing the chin guard 2 from the full-helmet structure position to the semi-helmet structure position in the embodiments of the present disclosure, FIGS. 5A through 5E show the changes during the whole process: FIG. 5A shows a full-helmet position state where the chin guard 2 is located at the full-helmet structure; FIG. 5B shows a climbing position state where the chin guard 2 is in the opening process; FIG. 5C shows a striding position state where the chin guard 2 strides across the dome of the shell body 1 (this state is also a face-uncovered helmet state); FIG. 5D shows a falling position state where the chin guard 2 is retracted to a rear side of the shell body 1; and, FIG. 5E shows a semi-helmet position state where the chin guard 2 is retracted to the semi-helmet structure. Similarly, to more clearly illustrate the process from returning and recovering the chin guard 2 from the semi-helmet structure position to the full-helmet structure position in the embodiments of the present disclosure, FIGS. 6A through 6E show the changes during the whole process: FIG. 6A shows a semi-helmet position state where the chin guard 2 is located at the semi-helmet structure; FIG. 6B shows a climbing position state where the chin guard 2 climbs to the rear side of the shell body 1 during a return process of the chin guard 2; FIG. 6C shows a dome striding position state where the chin guard 2 strides across the dome of the shell body 1; FIG. 6D shows a buckling position state where the chin guard 2 is in the last return process; and, FIG. 6E shows a full-helmet position state where the chin guard 2 returns to the full-helmet structure. It is not difficult to find from FIGS. 5A through 5E and 6A through 6E that, at various structure positions of the chin guard 2 and during various turnover processes of the chin guard 2, the through slot 6 is completely covered by the narrow body of the branch 2*a* of the chin guard 2 without being exposed. Accordingly, it is proved that the through slot 6 can be completely covered and not exposed in a full-time and full-process manner in the embodiments of the present disclosure. There is no doubt that, in the embodiments of the present disclosure, the inner gear 4 and the outer gear 4 are rotatable and meshed with each other to constitute a kinematic pair, the inner gear 4 and the branch 2*a* are in sidling fit with each other to constitute a slidable kinematic pair, and the rotation of the outer gear 5 is transferred to the branch 2*a* by the drive member 7 such that the branch 2*a* is extended or retracted relative to the inner gear 4, whereby the position and posture of the chin guard 2 can be accurately changed along with the process of opening or buckling the chin guard 2, and finally the reliable transform of the chin guard 2 between the full-helmet structure position and the semi-helmet structure position can be realized. Obviously, in view of the properties of the gear meshing transmission, in the embodiments of the present disclosure, the uniqueness and reversibility of the geometric movement trajectory of the chin guard 2 when the position and posture of the chin guard 2 are changed can be maintained. That is, a certain specific position of the chin guard 2 necessarily corresponds to a specific and unique posture of the chin guard 2. Moreover, no matter the inner gear 4 and the outer gear 5 perform positive rotations or reverse rotations, the posture of the chin guard 2 at a particular rotation moment must be unique and can deduce backwards. Further, in the embodiments of the present disclosure, the branch 2*a* of the chin guard 2 can substantially or even completely cover the through slot 6 in the inner gear 4, such that external foreign matters can be prevented from entering the constraint pair, and the reliability of the helmet when in use is ensured; and, the path of external noise entering the inside of the helmet can be blocked, thereby improving the comfort of the helmet when in use. Furthermore, since the motion of the outer gear 5 is fixed-axis rotation in the embodiments of the present disclosure, that is, the space occupied by the outer gear 5 when operating is relatively small, a more flexible choice is provided for the arrangement of fastening structures on the supporting base 3 having relatively low rigidity and strength. For example, fastening reinforcement ribs and fastening screws or other constructions/structures/parts may be arranged on an outer periphery of the outer gear 5 and on inner and outer peripheries of the inner gear 4. These fastening reinforcement measures are not comprehensive enough in the existing gear-constraint transformable chin guard structure technologies. Therefore, according to the embodiments of the present disclosure, the supporting rigidity of the supporting base 3 can be improved, thereby the overall safety of the helmet can be improved. It is worth mentioning that the technical solutions provided by the existing gear-constraint transformable chin guard structure technologies such as CN105901820A, CN101331994A and WO2009095420A1 adopt the structure and operation mode of movable gears or movable racks that swing and rotate with the chin guard 2, so the space swept by these gears or racks is very large, and this structural design has a negative effect on the rigidity and strength of the helmet. This is another significant difference between the helmet with the gear-constraint transformable chin guard structure of the present disclosure and these of existing technologies.

Figure 29A:
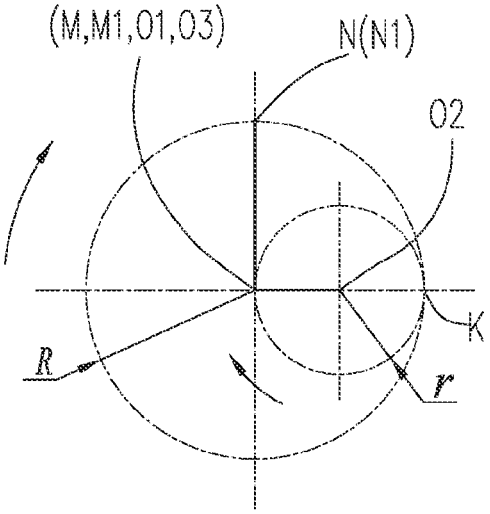
FIGS. 29A through 29B are schematic diagrams showing a geometric relationship in the embodiment shown in FIGS. 28A through 28B.
Figure 29B:
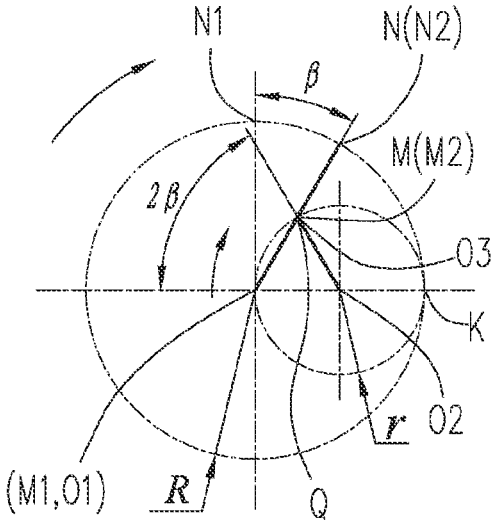
Figure 30A:
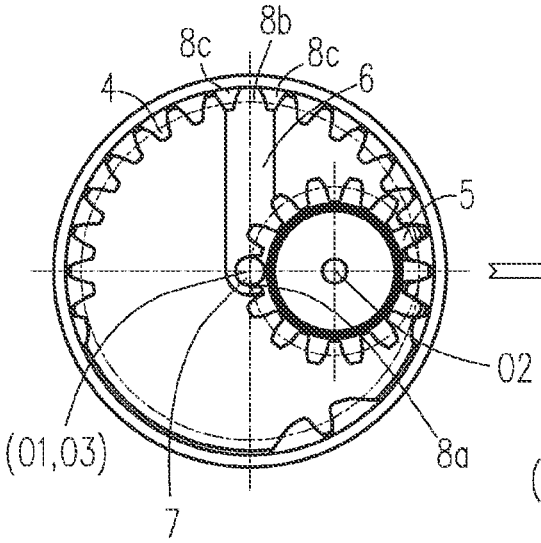
FIGS. 30A through 30B are schematic diagrams when a ratio of an inner-gear full-circumference equivalent teeth number ZR converted from meshing elements of the inner gear to an outer-gear full-circumference equivalent teeth number Zr converted from meshing elements included in the outer gear satisfies a relationship ZR/Zr=2, according to an embodiment of the present disclosure.
Figure 30B:
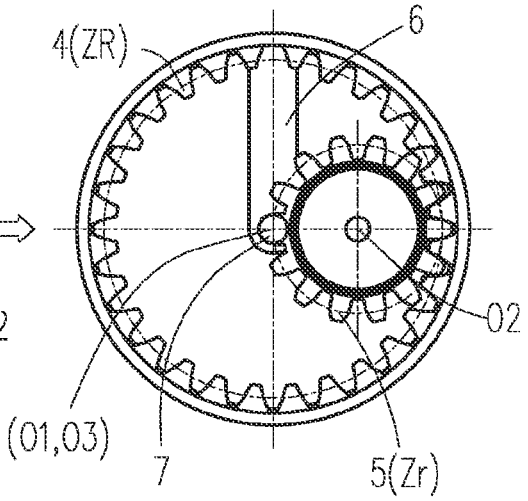
Figures 31A, 31B, 31C, 31D, 31E:
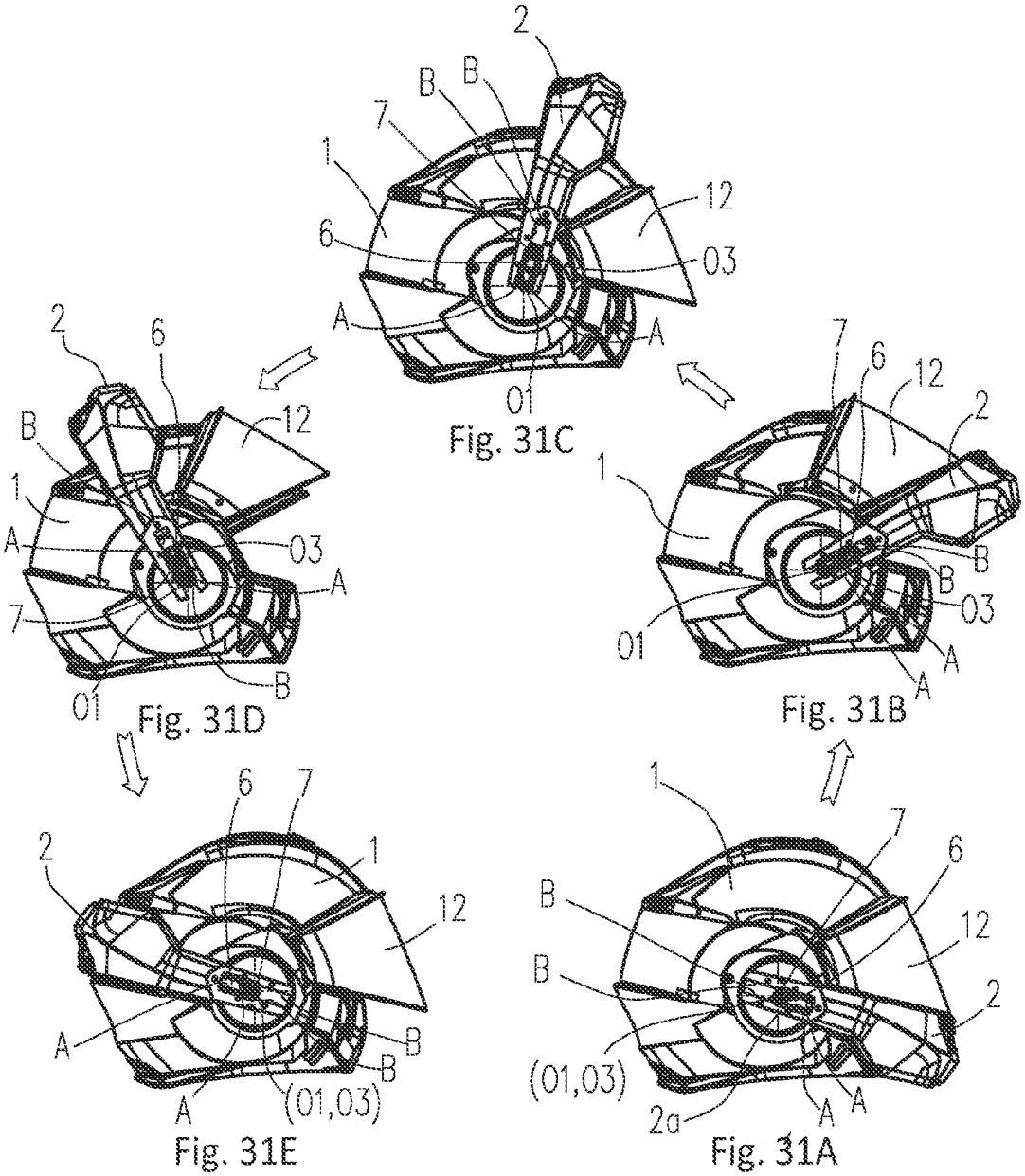
FIGS. 31A through 31E are schematic diagrams showing state changes of a relative positional relationship between the corresponding straight through slot, the constraint slide rails in a linear slidable kinematic pair and a drive member along with the turnover motion of the chin guard in the helmet with the gear-constraint transformable chin guard structure according to an embodiment of the present disclosure, when the ratio of the pitch radius R of the inner gear to the pitch radius r of the outer gear is R/r=2:1 or the ratio of the inner-gear full-circumference equivalent teeth number ZR to the outer-gear full-circumference equivalent teeth number Zr is ZR/Zr=2.

In the embodiments of the present disclosure, in the associated mechanism, the kinematic pair constituted by the inner gear 4 and the outer gear 5 may belongs to a planar gear drive mechanism, characterized in that: the inner gear 4 and the outer gear 5 meshed with each other have parallel axes, that is, the inner gear axis O1 of the inner gear 4 and the outer gear axis O2 of the outer gear 5 are parallel to each other. It is to be noted that, in the embodiments of the present disclosure, particularly, the inner gear axis O1 about which the inner gear 4 being rotatable is a fixed axis, and the outer gear axis O2 about which the outer gear 5 being rotatable is also a fixed axis. Thus, the inner gear 4 having inner tooth properties and the outer gear 5 having outer tooth properties obviously have the same rotation direction when they are meshed with each other (see FIGS. 28A through 28B and 29A through 29B). Here, the inner gear axis O1 and the outer gear axis O2 are preferably arranged to be perpendicular to the symmetry plane P of the shell body 1. Further, in the associated mechanism, the inner gear 4 and the outer gear 5 in the embodiments of the present disclosure may be cylindrical gears, including straight gears (as shown in FIGS. 14, 16, 17 through 19, 27 and 28A through 28B) and bevel gears (not shown). Such an arrangement has an advantage that the gear meshing pair constituted by the inner gear 4 and the outer gear 5 can better adapt and conform to the appearance design of the helmet in terms of space occupation, because the structure of this gear configuration is relatively flat and can easily satisfy the strict requirement of the shell body 1 on the thickness, particularly the thickness in a direction perpendicular to the symmetry plane P of the shell body 1. Obviously, the inner gear 4 and the outer gear 5 of the cylindrical gear type have a small size in a direction perpendicular to the symmetry plane P and thus have the advantage of small space occupation. Particularly, in the embodiments of the present disclosure, when the inner gear 4 and the outer gear 5 are meshed with each other, the pitch radius R of the inner gear 4 and the pitch radius r of the outer gear 5 satisfies a relationship: R/r=2 (see FIGS. 27 through 29B), wherein the pitch radius R of the inner gear 4 is constituted on the inner gear 4, the pitch radius r of the outer gear 5 is constituted on the outer gear 5, and the pitch circle can be generated only when the inner gear 4 and the outer gear 5 are meshed with each other. Obviously, when the pitch radius R of the inner gear 4 and the pitch radius r of the outer gear 5 satisfy the relationship R/r=2, a speed of rotation of the inner gear 4 about the inner gear axis O1 is only half of a speed of rotation of the outer gear 5 about the outer gear axis O2, that is, the speed of rotation of the outer gear 5 is twice the speed of rotation of the inner gear 4, that is, an angle of rotation of the inner gear 4 (i.e., a central angle rotated with respect to the inner gear axis O1) is only half of an angle of rotation of the outer gear 5 (i.e., a central angle rotated with respect to the outer gear axis O2) after the two gears operate for a period of time in a meshed manner. When the inner gear 4 and the outer gear 5 are arranged according to this meshing constraint relationship in the embodiments of the present disclosure, the obtained helmet will and must have a rule of regulating and controlling the posture of the chin guard 2 having unique behaviors and distinct advantages (see the following description and evidence). It is to be noted that, when the inner gear 4 and the outer gear 5 are designed as standard gears, the pitch radius R of the inner gear 4 and the pitch radius r of the outer gear 5 will also be equal to their respective reference circle radii. Here, the inner gear 4 and the outer gear 5 always have a reference circle radius used for design, manufacturing and inspection, but the pitch radius R of the inner gear 4 and the pitch radius r of the outer gear 5 can generated only when the inner gear 4 and the outer gear 5 are meshed. It should be noted that, when the inner gear 4 or the outer gear 5 is provided with an abnormity tooth socket 8*b* to be meshed with an abnormity gear tooth 8*a*, the pitch radius of the meshed abnormity gear tooth 8*a* and abnormity tooth socket 8*b* is preferably designed according to the above rule. For example, in the embodiments of the FIGS. 27 and 28A through 28B, the pitch radius of the abnormity gear tooth 8*a* present on the outer gear 5 in the form of a tooth is only half of the pitch radius of the abnormity tooth socket 8*b* present on the inner gear 4 in the form of a tooth socket. Particularly, there is a preferred parameter design arrangement in the embodiments of the present disclosure, that is: all effective gear teeth including abnormity gear teeth and abnormity tooth sockets on the inner gear 4 have a uniform pitch radius R, and all effective gear teeth including abnormity gear teeth and abnormity tooth sockets on the outer gear 5 have a uniform pitch radius r (as shown in FIGS. 27 and 28A through 28B), because a simpler structural form and an optimal meshing fit mode will be realized when the inner gear 4 and the outer gear 5 are designed and arranged according to these parameters. In the embodiments of the present disclosure, when the effective gear teeth of the inner gear 4 and the outer gear 5 are configured according to the principle that the ratio of the pitch radius R of the inner gear 4 to the pitch radius r of the outer gear 5 satisfies the relationship R/r=2, one of the largest characteristics (see FIGS. 28A through 28B and 29A through 29B) is that: when the inner gear 4 and the outer gear 5 are rotatable and are meshed with each other, the pitch circle of the outer gear 5 must pass through the inner gear axis O1 of the inner gear 4 (obviously); and, when a point, that coincides with the inner gear axis O1, on the pitch circle of the outer gear 5 begins to rotate with the outer gear 5, this point must always fall on a certain radius of the inner gear 4 that rotates synchronously with the inner gear 4. In other words, if the drive member 7 is arranged on the pitch circle of the outer gear 5, the drive member 7 will always intersect with a certain radius of the inner gear 4 that rotates synchronously with the inner gear 4. In this way, the through slot 6 may be designed as a slot in the form of a straight line and the through slot 6 passes through or is aligned with the inner gear axis O1, such that the drive member 7 can substantially or even completely make a reciprocating motion smoothly in the through slot 6 (as shown in FIGS. 31A through 31E). Thus, the through slot 6 can be easily machined and conveniently assembled and debugged. More importantly, in this way, the body of the branch 2*a* of the chin guard 2 can more easily cover the through slot 6 such that the through slot 6 is less exposed or completely not exposed to the outside (see FIGS. 5A through 5E and 6A through 6E). Actually, it is not difficult to prove that, the above characteristics must be presented when the pitch radius R of the inner gear 4 and the pitch radius r of the outer gear 5 are formed when the inner gear 4 and the outer gear 5 are meshed with each other satisfy the relationship R/r=2 (see FIGS. 28A through 28B and 29A through 29B). 1) It is obvious that, when the pitch radius R of the inner gear 4 and the pitch radius r of the outer gear 5 satisfy the relationship R/r=2, the pitch circle of the outer gear 5 must pass through the inner gear axis O1. Since the pitch circle of the inner gear 4 must be tangent to the pitch circle of the outer gear 5, a tangent point K must fall in the plane constituted by the inner gear axis O1 and the outer gear axis O2 (that is, a focus point of the inner gear axis O1, a focus point of the outer gear axis O2 and the tangent point K must be collinear). 2) It is to be proved that, during the meshing movement of the inner gear 4 and the outer gear 5, a certain point M on the pitch circle of the outer gear 5 (the point M is always fixed on the outer gear 5 and rotates synchronously with the outer gear 5) will always fall on a certain radius O1N of the inner gear 4 (the radius O1N is always fixed on the inner gear 4 and rotates synchronously with the inner gear 4, that is, an endpoint N of the radius O1N is always fixed on the pitch circle of the inner gear 4 and rotates synchronously with the inner gear 4), with reference to FIGS. 28A through 28B and 29A through 29B, wherein FIG. 29A corresponds to FIG. 28A; FIG. 29B corresponds to FIG. 28B; FIGS. 28A and 29A show the position state of the inner gear 4 and the outer gear 5 at the beginning of movement (the initial position state may correspond to the posture of the chin guard 2 at the full-helmet structure position); and, FIGS. 28B and 29B show the position state of the inner gear 4 and the outer gear 5 after the meshing movement has been started and the meshing rotation has performed by a certain angle (this position state corresponds any intermediate posture of the chin guard 2 during a turnover process of the chin guard 2). In general, if it is assumed that the point M at the initial position shown in FIGS. 28A and 29A is located at a position M1 that coincides with the inner gear axis O1 (this position is also an axial focus point of the inner gear axis O1), the radius O1N is located at a position that is perpendicular to the plane constituted by the inner gear axis O1 and the outer gear axis O2, the endpoint N of the radius O1N at this time is located at a position N1 that is perpendicular to O1K, and an present position of the endpoint N may be denoted by N(N1) in the drawings. It is not difficult to find that a line segment O1N1 is a tangent line of the pitch circle of the outer gear 5, with a tangent point of (M1, O1); and, the revolution axis O3 of the drive member 7 exactly coincides with the inner gear axis O1. Therefore, the tangent point may also be denoted by (M, M1, O1, O3). After the inner gear 4 and the outer gear 5 perform a certain meshing rotation, the point M on the outer gear 5 is rotated to the position M2, and the point N on the inner gear 4 is correspondingly rotated to the position N2. Correspondingly, at this time, the present position of the point M may be denoted by M(M2) in the drawings, and the present position of the point N may be denoted by N(N2) in the drawings. Since the pitch radius R of the inner gear 4 and the pitch radius r of the outer gear 5 satisfy the relationship R/r=2, at this time, the central angle of the inner gear 4 rotated by the point N satisfies the relationship ∠N1O1N2=β, and the central angle of the outer gear 5 rotated by the point M satisfies the relationship ∠M1O2M2=2∠N1O1N2=2β. In FIG. 29B, if it is assumed that the point Q is an intersection point of the radius O1N2 of the inner gear 4 and the pitch circle of the outer gear 5, a line segment O1Q is a chord on the outer gear 5, and ∠N1O1Q is a chord tangent angle on the pitch circle of the outer gear 5. According to the geometric law, the chord tangent angle ∠N1O1Q is half of a circumferential angle of an included arc of the outer gear 5, and the circumferential angle is half of the central angle ∠M1O2Q of the arc of the outer gear 5 included by the chord tangent angle ∠N1O1Q. Or, in turn, there must be ∠M1O2Q=2∠N1O1Q=2∠N1O1N2=2β. As described above, when the pitch radius R of the inner gear 4 and the pitch radius r of the outer gear 5 satisfy the relationship R/r=2, ∠N1O2N2=2 is valid, thereby proving that the point Q coincides with M2. In other words, the points N2, M2 and M1 must be collinear. Due to the arbitrariness of the assumed angle ft, it means that, along with the meshing movement of the inner gear 4 and the outer gear 5, the point M must always fall on the radius O1N that rotates synchronously with the inner gear 4. Just because of the arbitrariness of the angle ft, any point on the outer gear 5 can be equivalent to the position of the point M2, and must fall on the dynamically rotated radius O1N along with the rotation of the outer gear 5. From another perspective, in the embodiments of the present disclosure, if the through slot 6 is designed in a straight line form and designed to be parallel to or even coincide with the radius O1N, and the drive member 7 is arranged on the pitch circle of the outer gear 5 (corresponding to the point M), then the drive member 7 can basically or even completely make a linear reciprocating motion smoothly in the through slot 6. To be observed more clearly and vividly, FIGS. 31A through 31E show the state change process of the linkage of the straight through slot 6 and the drive member 7 when the ratio of the pitch radius R of the inner gear 4 to the pitch radius r of the outer gear 5 satisfies the relationship R/r=2 (the buckle cover 2*b* is removed in FIGS. 31A through 31E), wherein FIG. 31A shows the full-helmet position state where the chin guard 2 is located at the full-helmet structure; FIG. 31B shows the climbing position state where the chin guard 2 is in the opening process; FIG. 31C shows a dome striding position state where the chin guard 2 strides across the dome of the shell body 1; FIG. 31D shows the falling position state where the chin guard 2 is retracted to the rear side of the helmet body 1; and, FIG. 31E shows the semi-helmet position state where the chin guard 2 is retracted to the semi-helmet structure. It is not difficult to find from the state change that the through slot 6 always rotates synchronously about the inner gear axis O1 along with the chin guar 2, and the drive member 7 (at this time, it is equivalent to the point M on the outer gear 5 in FIGS. 29A through 29B) always falls into the through slot 6 (at this time, it is equivalent to the radius O1N on the inner gear 4 in FIGS. 29A through 29B) during the rotation process. Obviously, if the buckle cover 2*b* is mounted, an effect equivalent to the effect shown in FIGS. 5A through 5E will be obtained, that is, the body of the branch 2*a* can completely cover the through slot 6 during the whole turnover process of the chin guard 2. It is to be noted that, the gear constraint mechanism has invertibility, so it is not difficult to achieve the effect shown in FIGS. 6A through 6E when the chin guard 2 returns from the semi-helmet structure position to the full-helmet structure position. Thus, in the embodiments of the present disclosure, the through slot 6 in the inner gear 4 may be designed as a flat straight through slot 6, and is arranged to point to the inner gear axis O1 of the inner gear 4 (as shown in FIGS. 4, 13 through 16, 27, 28A through 28B, 30A through 30B and 31A through 31E). At this time, the drive member 7 can always fall into the through slot 6 and smoothly make a linear reciprocating motion. It is to be particularly pointed out that, in the embodiments of the present disclosure, there is a case where the inner gear 4 and the outer gear 5 may be provided with effective gear teeth within a full circumferential range of 360 degrees. In this case, when the inner gear 4 and the outer gear 5 are meshed with each other, the pitch radius R of the inner gear 4 and the pitch radius r of the outer gear 5 also satisfy the relationship R/r=2. In this way, the number of all gear teeth including abnormity gear teeth 8*a* and modified gear teeth 8*c* of the outer gear 5 is only half the number of all gear teeth of the inner gear 4. For example, if the number of gear teeth of the inner gear 4 is 28, the number of gear teeth of the corresponding outer gear 5 should be 14. However, it is to be noted that, in this case, there must be redundant gear teeth among the 28 gear teeth on the inner gear 4, that is, not all the 28 gear teeth on the inner gear 4 will participate in meshing with the 14 gear teeth on the outer gear 5, because it is well-known that the chin guard 2 of the helmet is impossible and unnecessary to rotate unidirectionally by 270 degrees relative to the shell body 1. Actually, from a practical point of view, the maximum turnover angle of the chin guard 2 is preferably about 180 degrees, because the semi-helmet structure helmet constituted by the chin guard 2 turned over to this angle has better agreeableness and safety, and this arrangement easily adapts to the appearance modeling and particularly conforms to the aerodynamic principle, such that the gas flow resistance is low and the wind howling generated when the airflow flows through the outer surface of the helmet can be effectively reduced.

In the embodiments of the present disclosure, in the associated mechanism, the drive member 7 may be designed as a part including a revolution surface structure, wherein the revolution surface structure includes a revolution axis O3 that is always rotatable about the outer gear axis O2 along with the outer gear 5. The revolution axis O3 is arranged to be parallel to the outer gear axis O2 and intersect with the pitch circle of the outer gear 5 (see FIGS. 19, 28A through 28B, 29A through 29B, 30A through 30B and 31A through 31E). Here, the revolution surface structure may be in various forms, including various cylindrical surfaces, conical surfaces, spherical surfaces, ring surfaces, abnormal convolute surfaces or the like. It is to be noted that, the pitch circle of the outer gear 5 is constituted when the gear 5 is meshed with the inner gear 4 (at this time, a pitch circle of the inner gear tangent to the pitch circle of the outer gear is also constituted on the inner gear 4). Obviously, when the outer gear 5 is a standard gear, the pitch circle of the outer gear 5 coincides with the reference circle of the outer gear; and, when the outer gear 5 is a nonstandard gear, that is, when the outer gear 5 is a modified gear having a non-zero modification coefficient, the pitch circle of the outer gear does not coincide with the reference circle of the outer gear. Similarly, when the inner gear 4 is a standard gear, the pitch circle of the inner gear 4 coincides with the reference circle of the inner gear 4; and, when the inner gear 4 is a nonstandard gear, that is, when the inner gear 4 is a modified gear having a non-zero modification coefficient, the pitch circle of the inner gear 4 does not coincide with the reference circle of the inner gear 4. In the embodiments of the present disclosure, the drive member 7 is manufactured into a part including a revolution surface structure, a better fitting mode and better manufacturability can be realized when the drive member 7 is connected to the outer gear 5 and when the drive member 7 is connected to the branch 2*a* of the chin guard 2. It is well-known that the part having a revolution configuration is easy to machine and assemble and may adopt a typical hole-shaft fitting mode. In addition, in the embodiments of the present disclosure, the revolution axis O3 is arranged to intersect with the pitch circle of the outer gear 5 and be parallel to the outer gear axis O2, with one advantage that this arrangement can realize better spatial arrangement to balance the arrangement of the drive member 7 on the outer gear 5, the inner gear 4 and the through slot 6. Particularly, the drive member 7 can have better movement stability. As demonstrated above, when the revolution surface structure of the drive member 7 has a revolution axis O3 and the revolution axis O3 is arranged on the pitch circle of the outer gear 5 and parallel to the outer gear axis O2, the revolution axis O3 operates by a law that it always falls on a certain radius that rotates synchronously with the inner gear 4, such that good conditions are created for the shape design and arrangement design of the through slot 6. It is to be pointed out that, although the revolution axis O3 of the drive member 7 is parallel to the outer gear axis O2 of the outer gear 5 as described above, in the embodiments of the present disclosure, it is not required that the rotation axis O3 of the transmission member 7 be absolutely parallel to the outer gear axis O2 of the outer gear 5, rather these axes are allowed to have a non-parallelism error to a certain extent, that is, the non-parallelism between the revolution axis O3 and the outer gear axis O2 caused by various factors such as manufacturing error, mounting error, stress deformation, temperature deformation and vibration deformation is allowed. As long as the final comprehensive effect achieved by the non-parallelism error will not affect the normal turnover of the chin guard 2, the revolution axis O3 and the outer gear axis O2 are regarded as being arranged in parallel. Further, in the embodiments of the present disclosure, the revolution surface structure of the drive member 7 may be designed as a cylindrical surface (as shown in FIGS. 4, 17 through 18, 27, 28A through 28B, 29A through 29B, 30A through 30B and 31A through 31E), or may be designed as a circular conical surface (not shown). In this case, obviously, the drive member 7 has only two ends and only one revolution axis O3. It is well-known that the cylindrical surface and the circular conical surface are typical structural forms of various parts, and are convenient to machine and very reliable in fitting. It is to be noted that the circular conical surface described in the embodiments of the present disclosure includes a circular truncated cone. In addition, if the revolution surface structure of the drive member 7 in the embodiments of the present disclosure is designed as a cylindrical surface, it may be a cylindrical surface having a single diameter, or may be constituted by stacking a plurality of cylindrical surfaces having different diameters (however, these cylindrical surfaces must be arranged coaxially, that is, the drive member 7 has only one revolution axis O3). Particularly, in the embodiments of the present disclosure, the revolution surface structure of the drive member 7 further includes a situation: on the basis of the cylindrical surface or circular conical surface, revolution surface structures in other forms may be combined, for example, auxiliary process structural details such as chamfer, rounded corner and taper which are convenient to manufacture and mount and avoid stress concentration, provided that all the auxiliary process structural details do not damage the revolution surface structure of the drive member 7 connected to the outer gear 5 or the branch 2*a*.

In the embodiments of the present disclosure, the fitting and connection between the drive member 7 and the outer gear 5 and between the drive member 7 and the branch 2*a* in the associated mechanism may be realized by one of three situations. 1) The drive member 7 is fastened to or integrated with the outer gear 5, and the drive member 7 is in rotatable fit with the branch 2*a* (FIGS. 4 and 17 through 19 show an example of the drive member 7 and the outer gear 5 being integrated, and the drive member 7 in this case has an end in rotatable fit with a circular hole 2*c* on the buckle cover 2*b* in FIGS. 4 and 24 through 26). Alternatively, 2) the drive member 7 is in rotatable fit with the out gear 5, and the drive member 7 is fastened to or integrated with the branch 2*a* (not shown). Alternatively, 3) the drive member 7 is in rotatable fit with the outer gear 5, and the drive member 7 is also in rotatable fit with the branch 2*a* (not shown). Actually, in addition to the above three situations, in the embodiments of the present disclosure, the fitting and connection between the drive member 7 and the outer gear 5 and between the drive member 7 and the branch 2*a* may be realized by other types of fitting and connection methods. For example, the drive member 7 may be in rotatable fit and sliding fit with (i.e., in rotatable sliding fit with) the outer gear 5 and/or the branch 2*a* (not shown). As a typical example, the drive member 7 is in a cylindrical configuration, and a waist-shaped slot configuration connected to the drive member 7 is arranged on the outer gear 5 or the branch 2*a*, such that the drive member 7 can be in rotatable fit with the outer gear 5 or the branch 2*a* and also in sliding fit with the outer gear 5 or the branch 2*a*.

In the embodiments of the present disclosure, to avoid the loosening of the inner gear 4 and the outer gear 5 during the turnover process of the chin guard 2 and thus ensure the stability and reliability of the chin guard 2 during the pose change process, a first anti-disengagement member 9*a* capable of preventing axial endplay of the inner gear 4 may be arranged on the supporting base 3, the shell body 1 or/and the outer gear 5, and a second anti-disengagement member 9*b* capable of preventing axial endplay of the outer gear 5 may be arranged on the inner gear 4, the supporting base 3 or/and the shell body 1. Here, the prevention of axial endplay refers to stopping, blocking, preventing and limiting excessive displacement of the inner gear 4 and the outer gear 5, so as to prevent the inner gear 4 and the outer gear 5 from loosening by providing the first anti-disengagement member 9*a* and the second anti-disengagement member 9*b*, i.e., preventing the inner gear 4 and the outer gear 5 from affecting the normal turnover process of the chin guard 2 and from affecting the normal clamping stagnation of the chin guard 2 at the full-helmet structure position, the semi-helmet structure position or the face-uncovered structure position. In the embodiments of the present disclosure, the arrangement of the first anti-disengagement member 9*a* includes various situations, such as the first anti-disengagement member 9*a* being arranged on the supporting base 3, or on the shell body 1, or on the inner gear 4, or on any two or three of the supporting base 3, the shell body 1 and the inner gear 4. In the embodiments of the present disclosure, the arrangement of the second anti-disengagement member 9*b* includes various situations, such as the second anti-disengagement member 9*b* being arranged on the inner gear 4, or the supporting base 3, or on the shell body 1, or on any two or three of the inner gear 4, the supporting base 3 and the shell body 1. In the cases shown in FIGS. 4 and 10 through 12, the first anti-disengagement member 9*a* for preventing axial endplay of the inner gear 4 is arranged on the outer supporting plate 3*b* of the supporting base 3; while in the embodiments shown in FIGS. 4 and 13 through 16, the second anti-disengagement member 9*b* for preventing axial endplay of the outer gear 5 is arranged on the inner gear 4. Obviously, the arrangement of the first anti-disengagement member 9*a* and the second anti-disengagement member 9*b* in the embodiments of the present disclosure is not limited to the cases shown in FIGS. 4 and 10 through 16. It is to be pointed out that, in the embodiments of the present disclosure, the first anti-disengagement member 9*a* and the second anti-disengagement member 9*b* may be in a flanged configuration (as shown in FIGS. 4 and 10 through 12), a buckle configuration (i.e., clamping by a snap hook configuration, not shown), a clamping ring configuration (i.e., clamping by a clamping spring structure, not shown), a fastening screw configuration (i.e., clamping by a fastening screw structure, not shown), a locking pin configuration (i.e., clamping by a locking pin, not shown), a cover plate structure (as shown in FIGS. 4 and 13 through 16, the second anti-disengagement member 9*b* of the cover plate structure in the drawings may be a configuration of the body of the inner gear 4 or a configuration of an extension of the inner gear 4), or even a magnetic attractable member (not shown) or other types of configurations or members. As described above, the first anti-disengagement member 9*a* may be a portion of the configuration of the supporting base 3 (as shown in FIGS. 4 and 10 through 12), or a portion of the configuration of the shell body 1 (not shown) or a portion of the configuration of the outer gear 5 (not shown), and the second anti-disengagement member 9*b* may be a portion of the configuration of the inner gear 4 (as shown in FIGS. 4 and 13 through 16). In addition, the first anti-disengagement member 9*a* may be an independent part fastened to the supporting base 3 or the shell body 1 or the outer gear 5 (not shown), and the second anti-disengagement member 9*b* may be an independent part fastened to the inner gear 4 or the supporting base 3 or the shell body 1 (not shown). Similarly, to prevent the disengagement of the chin guard 2 from the shell body 1, in the embodiments of the present disclosure, a third anti-disengagement member 9*c* capable of preventing axial loosening of the branch 2*a* of the chin guard 2 may be arranged on the inner gear 4 (as shown in FIGS. 4, 13, 15 and 31A through 31E). The third anti-disengagement member 9*c* may be an integral portion of the body (including an extension or elongation of the body) of the inner gear 4 (as shown in FIGS. 4, 13, 15 and 31A through 31E), or may be an independent part fastened to the inner gear 4 (not shown). In addition, the third anti-disengagement member 9*c* may be in a flanged configuration (as shown in FIGS. 4, 13, 15 and 31A through 31E), or may be in a configuration form such as a clamping groove, a clamping screw, a clamping collar or a clamping cover (not shown), or may be various types of configurations in the prior art. The flanged configuration is preferable therein, because the flanged configuration is easy to manufacture and assemble, and in particular may even constitute a portion or all of the slidable kinematic pair between the chin guard 2 and the branch 2*a*. It is to be noted that, in the embodiments of the present disclosure, the flange in the third anti-disengagement member 9*c* having the flanged configuration may be in various forms. For example, in the cases shown in FIGS. 4, 13, 15 and 31A through 31E, the flange of the third anti-disengagement member 9*c* having the flanged configuration is oriented away from the through slot 6, that is, the flanged configuration is directed to the outside of the through slot 6. Actually, in addition to this, the flange of the third anti-disengagement member 9*c* having the flanged configuration in the embodiments of the present disclosure may be oriented towards the through slot 6 (not shown). As described above, in the embodiments of the present disclosure, the third anti-disengagement member 9*c* is provided to prevent the axial disengagement of the branch 2*a* of the chin guard 2 from the inner gear 4. Here, the "axial disengagement" refers to a situation where the branch 2*a* is disengaged from the inner gear 4 to affect the normal turnover process of the chin guard 2 in the axial direction of the inner gear axis O1. It is to be pointed out that, in the embodiments of the present disclosure, the function of the third anti-disengagement member 9*c* is to prevent the axial disengagement of the branch 2*a* of the chin guard 2 from the inner gear 4, without impeding the reciprocating extension/retraction behavior of the slidable kinematic pair constituted by the branch 2*a* and the inner gear 4.

Figure 14:
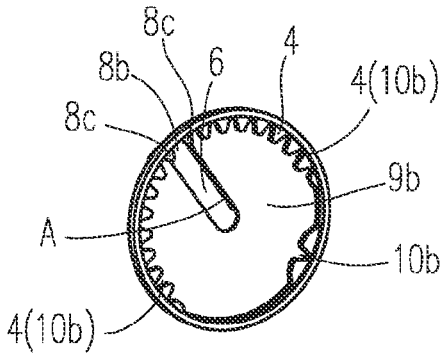
FIG. 14 is an axonometric view of the inner gear in FIG. 13 when viewed in another direction.
Figure 15:
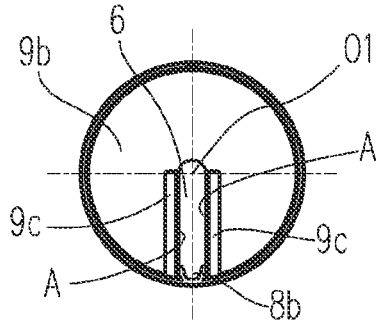
FIG. 15 is a radial diagram of the inner gear in FIG. 13 when viewed in a direction from the outside of the helmet to the shell body of the helmet along the inner gear axis.
Figure 16:
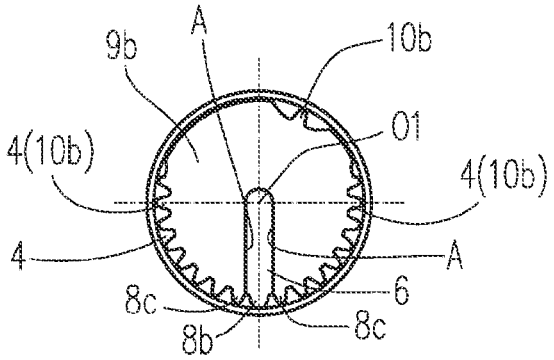
FIG. 16 is a radial diagram of the inner gear in FIG. 13 when viewed in a direction from the shell body inside the helmet to the outside of the helmet along the inner gear axis.
Figure 17:
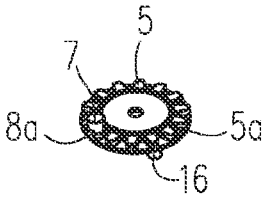
FIG. 17 is an axonometric view of the outer gear in the helmet with the gear-constraint transformable chin guard structure according to an embodiment of the present disclosure.
Figure 18:
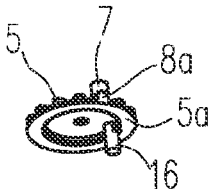
FIG. 18 is an axonometric view of the outer gear in FIG. 17 when viewed in another direction.
Figure 19:
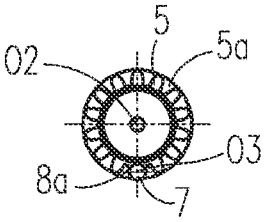
FIG. 19 is a radial diagram of the outer gear in FIG. 17 when viewed in a direction from the outside of the helmet to the shell body of the helmet along the outer gear axis.
Figure 20:
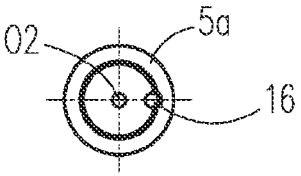
FIG. 20 is a radial diagram of the outer gear in FIG. 17 when viewed in a direction from the shell body inside the helmet to the outside of the helmet along the outer gear axis.
Figure 21:
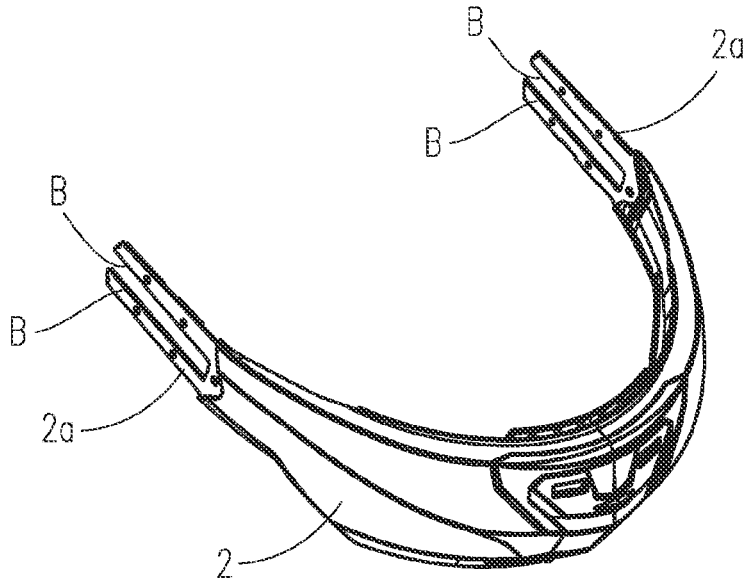
FIG. 21 is an axonometric diagram of an embodiment of the chin guard and branches thereof.
Figure 22:
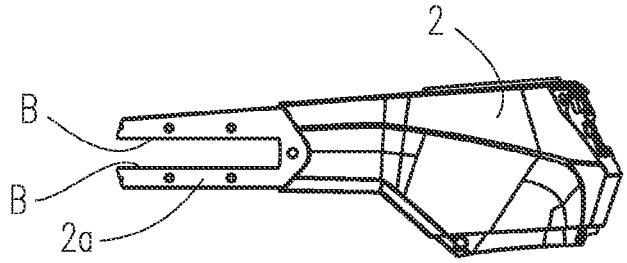
FIG. 22 is a side view of the chin guard and branches thereof in FIG. 21.

In the embodiments of the present disclosure, to realize better arrangement of the drive member 7, at least one of effective gear teeth of the outer gear 5 may be designed as an abnormity gear tooth 8*a* having a thickness greater than an average thickness of all effective gear teeth on the outer gear 5. In other words, from the appearance, the abnormity gear tooth 8*a* on the outer gear 5 is firstly a gear tooth in an entity form, that is, the abnormity gear tooth 8*a* is in a tooth form. Secondly, the abnormity gear tooth 8*a* has a larger size than other normal effective gear teeth (as shown in FIGS. 17 and 19). Of course, it is necessary to constitute an abnormity tooth socket 8*b* in a tooth socket form on the inner gear 4 to be meshed with the abnormity gear tooth 8*a* on the outer gear 5. Obviously, the abnormity tooth socket 8*b* on the inner gear 4 should correspondingly have a width larger than that of other normal gear teeth (as shown in FIGS. 14 and 16). Here, in the embodiments of the present disclosure, the drive member 7 is mated only with the abnormity gear tooth 8*a* on the outer gear 5 (see FIGS. 27 and 28A through 28B). The abnormity gear tooth 8*a* having a relatively large thickness is provided on the outer gear 5 to enable the revolution surface structure of the drive member 7 mated with the abnormity gear tooth 8*a* to have a larger diameter, such that the strength and rigidity of the drive member 7 can be better ensured, thereby the reliability and safety of the helmet can be improved.

In the embodiments of the present disclosure, to enable the chin guard 2 to smoothly and reliably complete various pose transform processes, the through slot 6 in the inner gear 4 may be designed as a flat straight through slot, i.e., a straight through slot 6, and the straight through slot 6 is arranged to point to or pass through the inner gear axis O1 (see FIGS. 15, 16, 27, 28A through 28B and 31A through 31E). In addition, the slidable kinematic pair constituted by the inner gear 4 and the branch 2*a* in slidable fitting is designed as a linear slidable kinematic pair, and the linear slidable kinematic pair is arranged to point to or pass through the inner gear axis O1. Moreover, the straight through slot 6 and the linear slidable kinematic pair are overlapped with each other or parallel to each other. Here, the through slot 6 being designed as a "flat straight through slot" means that, when viewed in the axial direction of the inner gear axis O1, the through slot 6 may be in the shape of a flat long strip and have a slot edge configuration in the form of a straight edge and can be seen through. In addition, the "straight through slot 6 being arranged to point to or pass through the inner gear axis O1" means that, if the body configuration of the through slot 6 is orthogonally projected to the symmetry plane P of the helmet, its projection set intersects with a projection focus point of the inner gear axis O1; or, if the projection set extends along the geometric symmetry line of the projection set, the projection set must sweep through the projection focus point of the inner gear axis O1, particularly the symmetry line of the projection set passes through the projection focus point of the inner gear axis O1 (see FIGS. 15, 16, 27, 28A through 28B and 31A through 31E). Here, "the slidable kinematic pair constituted by the inner gear 4 and the branch 2*a* in slidable fitting is designed as a linear slidable kinematic pair" means that the constraint behavior of the kinematic pair has an effect of allowing the mutual movement between the inner gear 4 and the branch 2*a* to be linear displacement. In addition, "the linear slidable kinematic pair being arranged to point to or pass through the inner gear axis O1" means that at least one of configurations, structures or parts (e.g., the body of the branch 2*a*, etc.) forming the linear slidable kinematic pair is in a state of pointing to or passing through the inner gear axis O1 (see FIGS. 5A through 5E, 6A through 6E and 31A through 31E). Here, "the straight through slot 6 and the linear slidable kinematic pair being overlapped with each other or parallel to each other" means that, if the through slot 6 and the slidable kinematic pair are orthogonally projected to the symmetry plane P of the helmet, it can be found that their projections are intersected, particularly the geometric symmetry line of the projection set of the straight through slot 6 and the geometric symmetry line of the projection set of the linear slidable kinematic pair are parallel to each other, particularly being overlapped with each other. In the embodiments of the present disclosure, through the coordination of the straight through slot 6 and the linear slidable kinematic pair and by arranging the straight through slot 6 and the linear slidable kinematic pair to be overlapped with each other or parallel to each other, at least two advantages can be achieved. Firstly, the drive member 7 can smoothly make a reciprocating motion in the through slot 6 without interference. Secondly, conditions can be provided for the branch 2*a* to completely cover the through slot 6. As described above, at this time, the movement trajectory of the drive member 7 is linear and reciprocating, and the linear trajectory can always follow the straight through slot 6 constituted in the inner gear 4 in the radial direction. Thus, there is no doubt that the drive member 7 can easily realize no motion interference with the through slot 6 (see FIGS. 31A through 31E). On one hand, it is to be noted that, the branch 2*a* of the chin guard 2 has the same angular speed and the same rotation direction as the inner gear 4 (i.e., the through slot 6). At this time, the through slot 6 may be actually designed as a flat and narrow straight slot, which creates conditions for the body of the branch 2*a* arranged on the outer side and having a narrow structure to completely cover the through slot 6 in a full-time and full-process manner. In other words, the through slot 6 can be completely covered in a full-time and full-process manner even if the body of the branch 2*a* of the chin guard 2 is narrow, because the body of the branch 2*a* of the chin guard 2 can be well pressed against the outer surface of the through slot 6 in the inner gear 4 whenever the chin guard 2 is located at the full-helmet structure position, the semi-helmet structure position or any intermediate position during a turnover process of the chin guard 2.

In the embodiments of the present disclosure, to increase the turnover degree of the chin guard 2 so as to adapt and conform to higher appearance and aerodynamic requirements, such an arrangement can be provided: when the chin guard 2 is at the full-helmet structure position, the revolution axis O3 of the drive member 7 in at least one associated mechanism is overlapped with the inner gear axis O1 (see FIGS. 5A through 5E, 6A through 6E and 31A through 31E), and the linear constraint elements included in the slidable kinematic pair in this associated mechanism are perpendicular to the plane constituted by the inner gear axis O1 and the outer gear axis O2 (see FIGS. 31A through 31E), wherein the described "linear constraint elements" are valid on the basis that the structures or members on the inner gear 4 and the branch 2*a* actually participating in the constraint behavior belong to the linear slidable kinematic pair, that is, the "linear constraint elements" include structures and parts of a linear configuration. These structures and members include, but not limited to, grooves, rails, rods, sides, keys, shafts, holes, sleeves, columns, screws or the like. In the case shown in FIG. 4, a linear slidable kinematic pair constituted by straight-side first slide rails A and straight-side second slide rails B is provided, and when the chin guard 2 is at the full-helmet structure position, the linear constraint elements (i.e., the second slide rails B and the first slide rails A) in the slidable kinematic pair are perpendicular to the plane constituted by the inner gear axis O1 and the outer gear axis O2. FIG. 31A shows that the position and the posture of the linear slidable kinematic pair at the full-helmet structure position are arranged to be perpendicular to the plane constituted by the inner gear axis O1 and the outer gear axis O2. Such an arrangement is not only advantageous for the appearance design of the helmet, but also allows the body of the branch 2*a* to better cover the through slot 6 in the inner gear 4 (see FIGS. 5A through 5E and FIGS. 6A through 6E). To more clearly observe the influencing process of the linear slide rail type slidable kinematic pair on the turnover behavior of the chin guard 2, FIGS. 31A through 31E show the state relationship among the branch 2*a* with the buckle cover 2*b* removed, the through slot 6 and the drive member 7: wherein FIG. 31A shows that the chin guard 2 is located at the full-helmet structure position, the second slide rails B and the first slide rails A in the linear slidable kinematic pair are perpendicular to the plane constituted by the inner gear axis O1 and the outer gear axis O2, the revolution axis O3 of the drive member 7 coincides with the inner gear axis O1, and the drive member 7 is located at the innermost end of the through slot 6 (the innermost end is a movement limit point of the drive member 7 relative to the through slot 6); FIG. 31B shows that the chin guard 2 is in a position state where it is opened and begins to climb, both the second slide rails B and the first slide rails A in the linear slidable kinematic pair rotate synchronously about the inner axis gear O1 along with the inner gear 4, and the drive member 7 slides to a certain intermediate portion of the through slot 6; FIG. 31C shows that the chin guard 2 is located at or near the dome of the shell body 1 (i.e., in a face-uncovered structure position state), both the second slide rails B and the first slide rails A in the linear slidable kinematic pair continuously rotate synchronously about the inner axis gear O1 along with the inner gear 4, and the drive member 7 slides to the outermost end of the through slot 6 (the outermost end is another movement limit point of the drive member 7 relative to the through slot 6); FIG. 31D shows that the chin guard 2 is in a position state where it falls back to the rear side of the shell body 1, both the second slide rails B and the first slide rails A in the linear slidable kinematic pair still continuously rotate synchronously about the inner axis gear O1 along with the inner gear 4, and the drive member 7 slides back to an certain intermediate portion of the through slot 6; and, FIG. 31E shows that the chin guard 2 is in a state where it falls back to the rear side of the shell body 1, i.e., reaching the semi-helmet structure position (it is to be noted that, in this state, the second slide rails B and the first slide rails A in the linear slidable kinematic pair may be or may not be perpendicular to the plane constituted by the inner gear axis O1 and the outer gear axis O2; when the second slide rails B and the first slide rails A in the linear slidable kinematic pair are perpendicular to the plane constituted by the inner gear axis O1 and the outer gear axis O2, the revolution axis O3 of the drive member 7 coincides with the inner gear axis O1 again, and the drive member 7 returns to the innermost end of the through slot 6; and, the chin guard 2 is just rotated by 180 degrees relative to the shell body 1 when the chin guard 2 is turned over from the full-helmet structure position to the semi-helmet structure position). It is not difficult to find that such a design in the embodiments of the present disclosure has at least two meanings and the following benefits obtained therefrom. Firstly, the extension/retraction displacement of the chin guard 2 relative to the shell body 1 can be maximized, that is, the maximum distance of travel of the chin guard 2 can be obtained, such that it is advantageous to improve the crossing ability of the chin guard 2, such as climbing and crossing the dome of the shell body 1 or crossing other attachments of the helmet or the like. Secondly, the turnover degree of the chin guard 2 relative to the shell body 1 can be maximized, thereby a more attractive appearance and better helmet aerodynamic performance can be obtained, since the revolution axis O3 coincides with the inner gear axis O1 at the full-helmet structure position. With such an arrangement, actually, the inner gear axis O1 of the inner gear 4 can be lifted closer to the dome of the shell body 1 to the greatest extent, and the space occupation of the inner gear 4 in the portion below the ear can be obviously reduced. This space occupation is very important for the appearance and wearing comfort of the helmet.

In the embodiments of the present disclosure, to ensure that the chin guard 2 can be effectively transformed from the full-helmet structure position to the semi-helmet structure position, a central angle $\alpha$ covered by all effective gear teeth on the inner gear 4 may be greater than or equal to 180 degrees (see FIG. 27). The main purpose of such a design is to ensure that the chin guard 2 has a large enough turnover range, so as to satisfy the requirement for transform between the full-helmet structure and the semi-helmet structure. In this way, the chin guard 2 can reach a maximum turnover angle of at least 180 degrees, and the semi-helmet structure helmet corresponding to the position of the chin guard 2 at this time obviously has a more attractive appearance and better aerodynamic performance. In addition, in the embodiments of the present disclosure, the central angle $\alpha$ may be less than 360 degrees, that is, the inner gear 4 does not have gear teeth completely arranged on a circumference of the inner gear 4. The advantage of this arrangement is that the inner gear 4 can have more space for the arrangement of other functional members such as clamping mechanism, locking mechanisms or bouncing mechanisms. For example, in the embodiment shown in FIGS. 32A through 32C, a clamping mechanism for clamping the chin guard 2 at a particular position is provided, which is just arranged within an encircling area of the inner gear 4 having gear teeth non-completely arranged on a circumference of the inner gear 4. Of course, even if the central angle $\alpha$ covered by all effective gear teeth on the inner gear 4 is equal to 360 degrees, that is, the inner gear 4 has gear teeth completely arranged on a circumference of the inner gear 4, it is also possible to arrange a clamping mechanism for clamping the chin guard 2 at a particular position, a locking mechanism and a bouncing mechanism (not shown). Since both the inner gear 4 and the outer gear 5 in the embodiments of the present disclosure are rotatable about fixed-axes, the space occupied by the inner gear 4 and the outer gear 5 is not large, such that related functional mechanisms may be arranged in areas on the inner side of the inner gear 4 and the outer side of the outer gear 5.

Figure 32A:
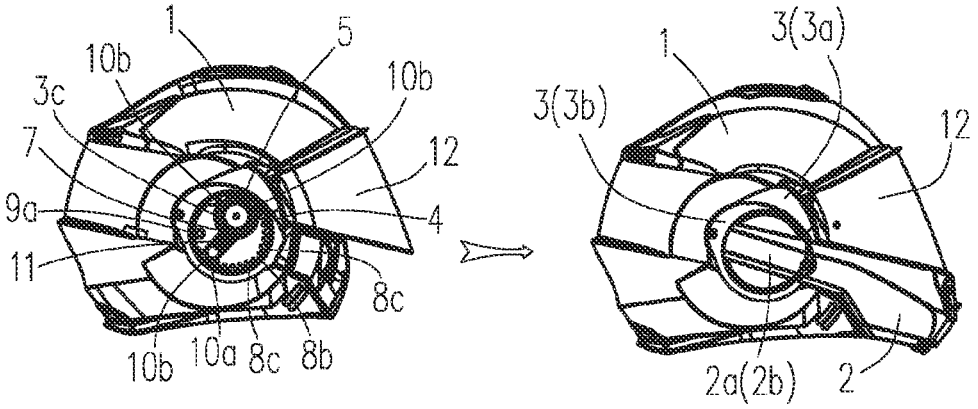
FIGS. 32A through 32C are schematic diagrams showing states of clamp-fitting between a first clamping structure and a second clamping structure in the helmet with the gear-constraint transformable chin guard structure according to an embodiment of the present disclosure, when the chin guard is in a full-helmet structure position state, a face-uncovered structure position state and a semi-helmet structure position state, respectively.
Figure 32B:
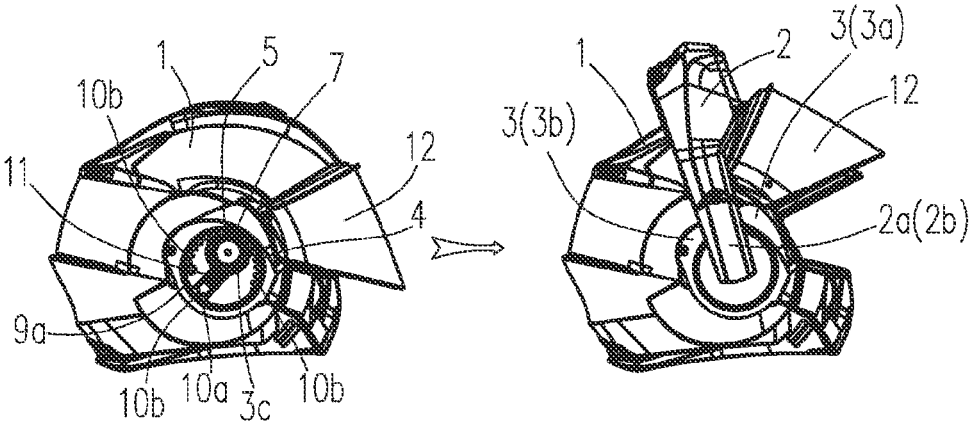
Figure 32C:
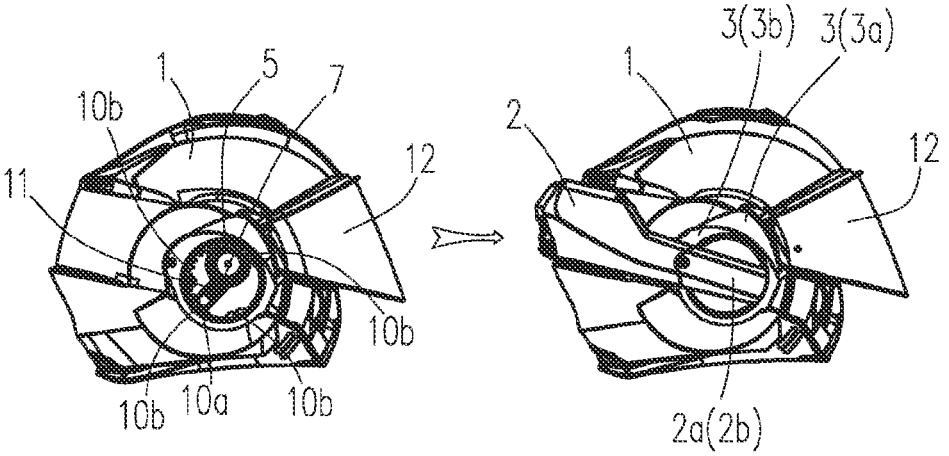

In the embodiments of the present disclosure, to enable the chin guard 2 to have certain stability at the full-helmet structure position, the semi-helmet structure position or even the face-uncovered structure position, i.e., to enable the chin guard 2 to be temporarily locked, blocked or stopped as required in the above position state, a first clamping structure 10*a* may be arranged on the supporting base 3 or/and the shell body 1, at least one second clamping structure 10*b* may be arranged on the body of the inner gear 4 or an extension of the inner gear 4, and an acting spring capable of pressing and driving the first clamping structure 10*a* close to the second clamping structure 10*b* may be arranged on the supporting base 3 or/and the shell body 1 (as shown in FIGS. 32A through 32C). The first clamping structure 10*a* and the second clamping structure 10*b* are male and female catching structures matched with each other. When the first clamping structure 10*a* and the second clamping structure 10*b* are clamp-fitted with each other, they can produce an effect of clamping and keeping the chin guard 2 in the present position and posture of the chin guard 2. At this time, an acting force for clamping a pose of the chin guard 2 mainly comes from a press force applied by the acting spring 11 and a friction force generated during clamp-fitting (the "pose" described in the embodiments of the present disclosure refers to a combination of the position and posture, and can be used to describe the state of the position and angle of the chin guard 2). Here, it is obvious that the second clamping structure 10*b* can rotate synchronously with the inner gear 4. When the second clamping structure 10*b* is clamp-fitted with the first clamping structure 10*a*, an effect of weakly locking the chin guard 2 can be achieved. That is, without forced intervention, the chin guard 2 can generally stay at the pose when being weakly locked. At this time, the chin guard 2 is kept at the present position mainly by the acting force of the acting spring 11 (of course, including the friction force for preventing the chin guard 2 from swaying). However, when the applied external force reaches a certain degree, the chin guard 2 can overcome the constraint of the above clamping structures and continuously make a turnover motion forcibly (at this time, the acting spring 11 is retreated to realize unlocking). To simplify the structure, in the embodiments of the present disclosure, the first clamping structure 10*a* may be designed as a convex tooth configuration, and the second clamping structure 10*b* may be designed as a groove configuration (as shown in FIGS. 32A through 32C). In addition, the second clamping structure 10*b* may be arranged in such a way that one second clamping structure 10*b* is clamp-fitted with the first clamping structure 10*a* when the chin guard 2 is at the full-helmet structure position (as shown in FIG. 32A) and another second clamping structure 10*b* is clamp-fitted with the first clamping structure 10*a* when the chin guard 2 is at the semi-helmet structure position (as shown in FIG. 32C). In this way, the chin guard 2 can be effectively locked at the full-helmet structure position and the semi-helmet structure position, such that the stability of the chin guard 2 (particularly the stability of the helmet when the wearer drives vehicles, operates machines and tools or performs other operations) can be improved. It is to be particularly pointed out that, in the embodiments of the present disclosure, the second clamping structure 10*b* may be a tooth socket of an effective gear tooth of the inner gear 4, that is, a tooth socket of an effective gear tooth of the inner gear 4 may be directly used as the second clamping structure 10*b*, or the second clamping structure 10*b* may be an integral portion of an effective gear tooth of the inner gear 4. In FIGS. 32A through 32C, when the chin guard 2 is at the full-helmet structure position and the semi-helmet structure position, the second clamping structure 10*b* in clamp-fit with the first clamping structure 10*a* is a tooth socket of an effective gear tooth of the inner gear 4. Furthermore, in the embodiments of the present disclosure, it is also possible to configure a second clamping structure 10*b* to be clamp-fitted with the first clamping structure 10*a* when the chin guard 2 is located at or near the dome of the shell body 1 (as shown in FIG. 32B). This arrangement is to additionally provide an intermediate structure pose between the full-helmet structure and the semi-helmet structure. Corresponding to this structure pose, the chin guard 2 is opened to the dome of the helmet or near the dome of the helmet. This structure pose is also a frequently used state at present, i.e., a state where the chin guard 2 is turned over to uncover the face (as shown in FIG. 32B). This state is advantageous for the driver to temporarily open the chin guard 2 of the helmet for various activities such as smoking, making a conversation, drinking water or taking a rest. In the embodiments of the present disclosure, the position of the chin guard 2 located at or near the dome of the shell body 1 is called a face-uncovered structure position. In other words, in the embodiments of the present disclosure, the helmet with a transformable chin guard structure may have at least three structure states, i.e., a full-helmet structure helmet, a semi-helmet structure helmet and a face-uncovered structure helmet, such that the comfort of the helmet when in use can be further improved. Further, to further improve the comfort of the helmet when in use, in the embodiments of the present disclosure, a booster spring (not shown) may be arranged on the supporting base 3 or/and the shell body 1. When the chin guard 2 is located at the full-helmet structure position, the booster spring is compressed and stores energy; when the chin guard 2 turns over from the full-helmet structure position to the face-uncovered structure position, the booster spring releases an elastic force to aid in opening the chin guard 2; and, when the chin guard 2 is in a state between the semi-helmet structure position and the face-uncovered structure position, the booster spring does not act on the chin guard 2, such that the turnover action of the chin guard 2 during this process will not be affected.

In the embodiments of the present disclosure, the following design and arrangement may be provided. In the meshing constraint pair constituted by the inner gear 4 and the outer gear 5 in at least one associated mechanism, in addition to the normal gear meshing, individual or several non-gear meshing behaviors may occur in the process of meshing between the inner gear 4 and the outer gear 5. That is, the meshing of some non-gear members having transitional properties, such as column/groove meshing or key/groove meshing, are allowed to be provided in certain gaps, segments or processes of the normal meshing of the inner gear 4 with the outer gear 5 (not shown). In the embodiments of the present disclosure, all structures and elements (including convex configurations and concave structures) that are arranged on the inner gear 4 or/and the outer gear 5 and actually participate in the meshing behaviors for motion transfer and power transfer between the inner gear 4 and the outer gear 5, for example normally configured effective gear teeth (including abnormity gear teeth 8*a* having a large shape, abnormity tooth sockets 8*b* having a larger tooth socket width and some modified gear teeth 8*c* having a small shape, see FIGS. 30A through 30B) and auxiliary non-gear meshing members or the like, are collectively called meshing elements. It is to be noted that, the meshing of these non-gear members is merely auxiliary, and the leading mechanisms for guiding and constraining the chin guard 2 to make extension/retraction displacement and change an angular swing phase of the chin guard 2 are still relies mainly on the conventional gear-type gear teeth for meshing constraint. Therefore, the properties and behaviors of the gear-constraint transformable chin guard structure in the embodiments of the present disclosure are not substantially changed. In this case, if it is assumed that the number of meshing elements of the inner gear 4 is calculated according to one complete circumference of 360 degrees and denoted as the inner-gear full-circumference equivalent teeth number ZR and the number of meshing elements of the outer gear 5 is calculated (or converted) according to one complete circumference of 360 degrees and denoted as the outer-gear full-circumference equivalent teeth number Zr, a ratio of the inner-gear full-circumference equivalent teeth number ZR to the outer-gear full-circumference equivalent teeth number Zr satisfies a relationship: ZR/Zr=2, with reference to FIGS. 30A through 30B. FIG. 30A shows that the meshing elements of the inner gear 4 actually participating in meshing are not circumferentially arranged at 360 degrees, and FIG. 30B shows that the inner-gear full-circumference equivalent teeth number ZR of the inner gear 4 is calculated (or converted) according to one complete circumference of 360 degrees. In FIG. 30B, the inner gear 4 may be denoted by an inner gear 4 (ZR) and the outer gear 5 may be denoted by an outer gear 5 (Zr), indicating that they are equivalently converted gears. For example, if it is assumed that the total number of all meshing members of the outer gear 5 actually participating in meshing is 14 and the 14 meshing elements are exactly distributed around one complete circumference by 360 degrees, the outer-gear full-circumference equivalent teeth number Zr is 14. In this case, correspondingly, only 14 meshing elements of the inner gear 4 are theoretically required to realize one-to-one pairing with the meshing elements of the outer gear 5. However, obviously, the inner gear 4 having only 14 meshing elements cannot be completely circumferentially distributed at 360 degrees. In the embodiments of the present disclosure, if the meshing elements of the inner gear 4 are configured according to the principle that the ratio of the inner-gear full-circumference equivalent teeth number ZR to the outer-gear full-circumference equivalent teeth number Zr satisfies the relationship ZR/Zr=2, the inner-gear full-circumference equivalent teeth number Zr will be 28. Thus, the relative position and space occupation of the inner gear 4 and the outer gear 4 in the shell body 1 can be arranged according to the parameters that the outer-gear full-circumference equivalent teeth number Zr is 14 and the inner-gear full-circumference equivalent teeth number Zr is 28. It is to be noted that, in practical applications, in the embodiments of the present disclosure, it is not required that the number of meshing elements of the inner gear 4 must be set according to the inner-gear full-circumference equivalent teeth number ZR, as long as the number of meshing elements of the inner gear 4 actually participating in meshing is not less than the number of meshing elements of the outer gear actually participating in meshing. In the embodiments of the present disclosure, the purpose of such an arrangement is to keep the rotation speed of the inner gear 4 always half the rotation speed of the outer gear, so as to ensure that the slidable kinematic pair and the through slot 6 have simple configurations, for example, a linear configuration or the like.

In the embodiments of the present disclosure, the following design and arrangement may be provided. A web plate 5*a* is arranged on the outer gear 5 in at least one associated mechanism (as shown in FIGS. 4 and 17 through 20). The web plate 5*a* may be arranged on a tooth end face of the outer gear 5 or any intermediate position on the outer gear 5 in a thickness direction of the outer gear 5, wherein it is most preferable that the web plate 5*a* is arranged at a teeth socket position on the tooth end face. In addition, the web plate 5*a* may be arranged on all gear teeth or some gear teeth of the outer gear 5, wherein it is preferable that the web plate 5*a* is arranged on all gear teeth. Further, the web plate 5*a* may be integrated with the outer gear 5 (as shown in FIGS. 4 and 17 through 19), or may be an independent member fastened to the outer gear 5 (not shown). In the embodiments of the present disclosure, by arranging the web plate 5*a* on the outer gear 5, the rigidity of the outer gear 5 can be improved, and the drive member 7 can be arranged on the web plate 5*a*.

Figure 24:
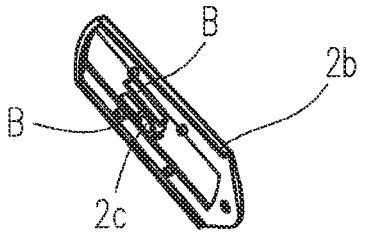
FIG. 24 is an axonometric diagram of an embodiment of the buckle cover of branches of the chin guard thereof.
Figure 25:
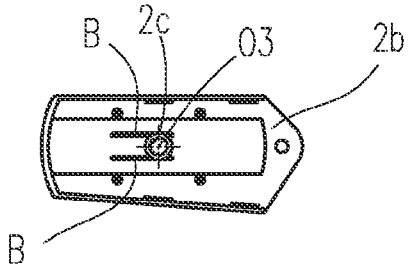
FIG. 25 is a radial diagram of the buckle cover in FIG. 24 when viewed in a direction from the shell body inside the helmet to the outside of the helmet.
Figure 26:
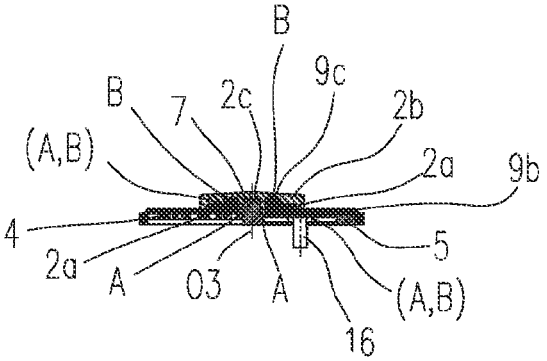
FIG. 26 is a sectional view of an embodiment of assembling the inner gear, the outer gear, the branches of the chin guard and the buckle cover for the branches of the chin guard.

In the embodiments of the present disclosure, the following design and arrangement may be provided. In at least one associated mechanism, the through slot 6 constituted in the inner gear 4 participates in the slidable constraint behavior of the inner gear 4 and the branch 2*a*, and the slidable constraint behavior constitutes a part or all of the slidable kinematic pair constituted by the inner gear 4 and the branch 2*a*. In the embodiments of the present disclosure, with such a design, the design of the helmet (particularly the structural design of the slidable kinematic pair constituted by the branch 2*a* of the chin guard 2 and the inner gear 4) can be simplified by fully utilizing the structural features of the through slot 6. In other words, two rail sides of the through slot 6 can also be used as first slide rails A of the slidable kinematic pair (as shown in FIGS. 4 and 13 through 16), and as long as second slide rails B matched with the first slide rails A are correspondingly arranged on the branch 2*a* (as shown in FIGS. 4, 24 and 25), the first slide rails A can be mated with the second slide rails B to constitute the slidable kinematic pair (see FIG. 26), whereby the relative sliding motion of the inner gear 4 and the branch 2*a* can be constrained and realized, and the moment of rotation between the inner gear 4 and the branch 2*a* can be transferred (that is, the turnover motion of the branch 2*a* can be transferred by the through slot 6 to drive the inner gear 4 to turn over synchronously along with the branch 2*a*, or in turn the turnover motion of the inner gear 4 can be transferred by the through slot 6 to drive the branch 2*a* to turn over synchronously along with the inner gear 4). It is to be noted that, in the embodiments of the present disclosure, the description "in at least one associated mechanism, the through slot 6 constituted in the inner gear 4 participates in the slidable constraint behavior of the inner gear 4 and the branch 2*a*, and the slidable constraint behavior constitutes a part or all the behaviors the slidable kinematic pair constituted by the inner gear 4 and the branch 2*a*" includes two situations: 1) in at least one associated mechanism, the through slot 6 and the branch 2*a* form a unique slidable kinematic pair between the inner gear 4 and the branch 2*a*; and 2) in at least one associated mechanism, the through slot 6 and the branch 2*a* form a portion of the slidable kinematic pair constituted by the inner gear 4 and the branch 2*a*. In other words, in addition to the slidable kinematic pair constituted by the through slot 6 and the branch 2*a*, there are other types of slidable kinematic pairs between the inner gear 4 and the branch 2*a*, and all the slidable kinematic pairs participate in constraining the extension/retraction and turnover behavior between the inner gear 4 and the branch 2*a*. Obviously, in the embodiments of the present disclosure, with the above arrangement, the space can be saved and a compact design can be realized; and, the structural reliability of the slidable kinematic pair can be improved, and the safety of the helmet can be further improved.

Figure 33A:
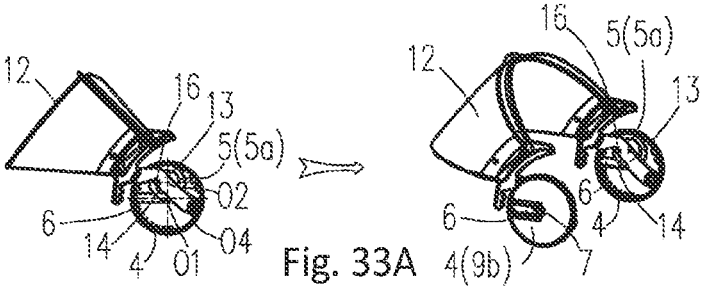
FIGS. 33A through 33E show side views and axonometric views of linkage of the inner gear, a trigger pin, legs of a visor and a load-bearing rail side in the helmet with the gear-constraint transformable chin guard structure according to an embodiment of the present disclosure, when the chin guard is moved from the full-helmet structure position to the semi-helmet structure position and the visor initially located at a fully buckled position is opened.
Figure 33B:
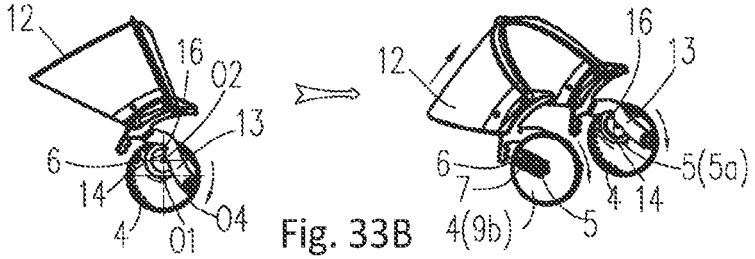
Figure 33C:
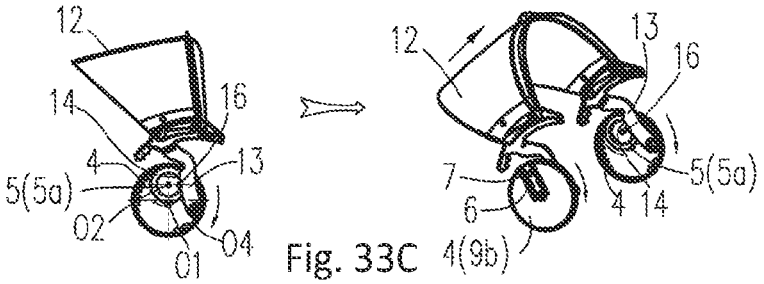
Figure 33D:
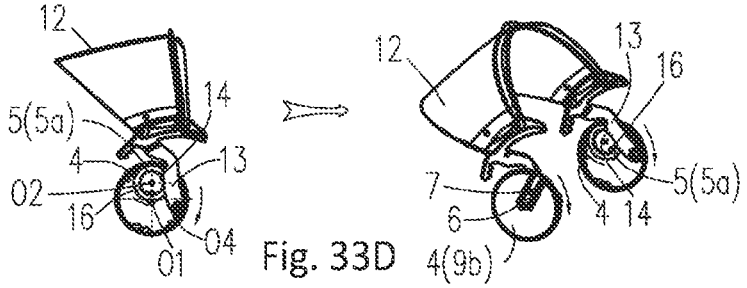
Figure 33E:
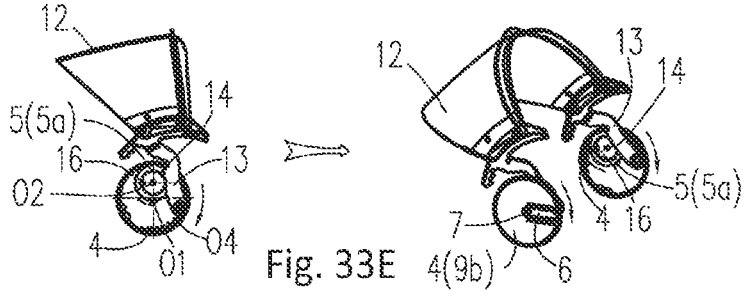
Figure 34A:
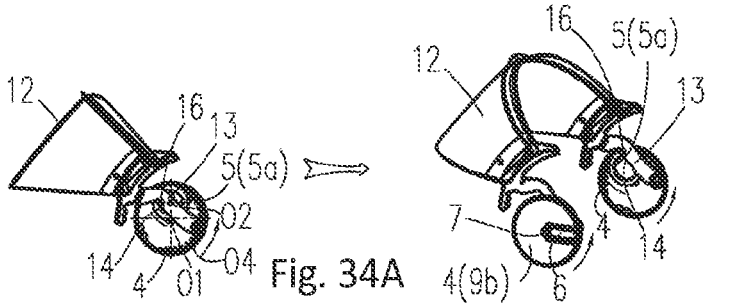
FIGS. 34A through 34E show side views and axonometric views of linkage of the inner gear, the trigger pin, legs of the visor and the load-bearing rail side in the helmet with the gear-constraint transformable chin guard structure according to an embodiment of the present disclosure, when the chin guard is returned from the semi-helmet structure position to the full-helmet structure position and the visor initially located at the fully buckled position is opened.
Figure 34B:
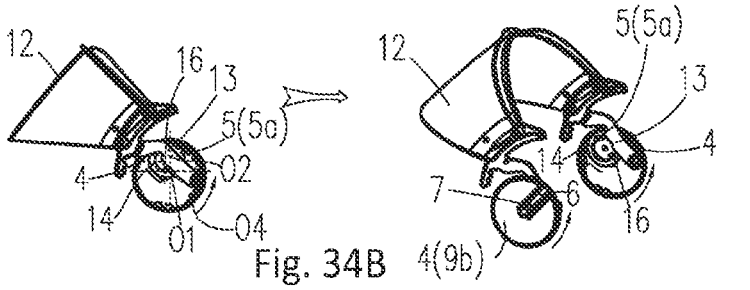
Figure 34C:
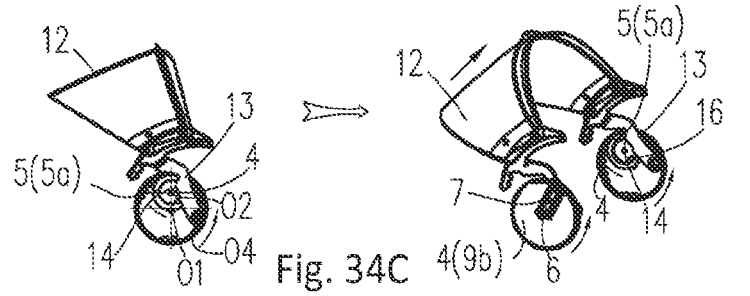
Figure 34D:
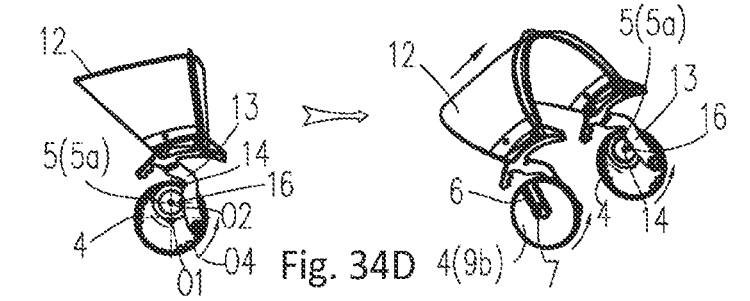
Figure 34E:
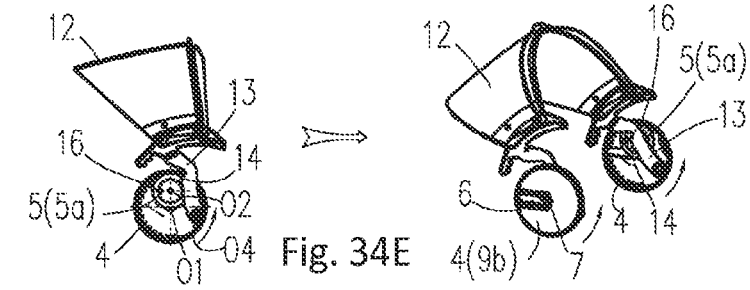

In the embodiments of the present disclosure, the following design and arrangement may be provided. The helmet may be configured with a visor 12. The visor 12 is made of a transparent material and functions to prevent sand and rain from entering the helmet. The visor 12 includes two legs 13 (see FIGS. 33A through 33E and 34A through 34E). The two legs 13 are arranged on two sides of the shell body 1, respectively, and can swing around a visor axis O4 relative to the shell body 1. That is, the visor 12 can be buckled to prevent wind, sand and rain, and the visor 12 can also be opened to facilitate the wearer's activities such as water drinking and conversation. A load-bearing rail side 14 is arranged on at least one of the two legs 13 of the visor 12 (as shown in FIGS. 33A through 36D), and the leg 13 with the load-bearing rail side 14 is arranged between the supporting base 3 and the shell body 1. A through opening 15 is constituted in the inner supporting plate 3*a* of the supporting base 3 facing the shell body 1 (as shown in FIGS. 4 and 7 through 9), and a trigger pin 16 extending out of the opening 15 and capable of coming into contact with the load-bearing rail side 14 of the leg 13 is arranged on the outer gear 5 (as shown in FIGS. 4, 17, 18, 20 and 33A through 36D). When the visor 12 is in a fully buckled and closed state, the arrangement of the trigger pin 16 and the load-bearing rail side 14 satisfies several conditions: if the chin guard 2 is opened from the full-helmet structure position, the trigger pin 16 must be able to come into contact with the load-bearing rail side 14 on the leg 13 of the visor 12 and thereby drive the visor 12 to turn over and open; and, if the chin guard 2 returns to the full-helmet structure position from the semi-helmet structure position, during the first two-thirds of the return trip of the chin guard 2, the trigger pin 16 must be able to come into contact with the load-bearing rail side 14 on the leg 13 of the visor 12 and thereby drive the visor 12 to turn over and open. Here, in the description "if the chin guard 2 is opened from the full-helmet structure position, the trigger pin 16 must be able to come into contact with the load-bearing rail side 14 on the leg 13 of the visor 12 and thereby drive the visor 12 to turn over", it is not required that the trigger pin 16 must immediately come into contact with the load-bearing rail side 14 of the leg 13 to drive the visor 12 to be immediately opened once the chin guard 2 is activated, and the chin guard 2 is allowed to be activated after a certain delay, including a delay due to functional design, a delay caused by elastic deformation of related parts, gap elimination or other reasons, or the like. Of course, in the embodiments of the present disclosure, there is a case where the trigger pin 16 immediately comes into contact with the load-bearing rail side 14 of the leg 13 to drive the visor 12 to be immediately opened once the chin guard 2 is activated. FIGS. 33A through 33E show the linkage process of the inner gear 4, the outer gear 5, the trigger pin 16, the visor 12 and the legs 13 of the visor 12 when the chin guard 2 is opened from the full-helmet structure position to the semi-helmet structure position (here, the chin guard 2 makes an initial turnover action), wherein FIG. 33A shows that the chin guard 2 is located at the full-helmet structure position to be turned over and the visor 12 is in the fully buckled state; FIG. 33B shows that the chin guard 2 begins to be turned over→the inner gear 4 rotates→the outer gear 5 is driven to rotate by the inner gear 4→the trigger pin 16 rotates synchronously with the outer gear 5→the trigger pin 16 comes into contact with and drives the load-bearing rail side 14 on the leg 13→the leg 13 begins to swing about the visor axis O4→the visor 12 begins to be opened and climb; FIG. 33C shows that the chin guard 2 is continuously turned over to the vicinity of the dome of the shell body 1→the inner gear 4 continuously rotates and drives the trigger pin 16 to continuously rotate by the outer gear 5→the trigger pin 16 pushes the load-bearing rail side 14 and continuously drives the visor 12 to swing upward and climb to the highest lifting position of the visor 12 by the load-bearing rail side 14; FIG. 33D shows that the chin guard 2 is continuously turned over to the rear side of the shell body 1→the inner gear 4 continuously rotates and drives the trigger pin 16 to continuously rotate by the outer gear 5, but at this time, the visor 12 has already reached and stayed at the highest lifting position and the trigger pin 16 has already moved away from the load-bearing rail side 14 of the leg 13; and, FIG. 33E show that the chin guard 2 already reaches the semi-helmet structure position, and the trigger pin 16 moves further away from the load-bearing rail side 14 of the leg 13 under the drive of the inner gear 4 and the outer gear 5. FIGS. 34A through 34E show the linkage process of the inner gear 4, the outer gear 5, the trigger pin 16, the visor 12 and the legs 13 of the visor 12 during the process of returning the visor 12 from the semi-helmet structure position to the full-helmet structure position, wherein FIG. 34A shows that the chin guard 2 is located at the semi-helmet structure position to be turned over and the visor 12 is in the fully buckled state; FIG. 34B shows that the chin guard 2 begins to return and turn over→the inner gear 4 rotates→the outer gear 5 is driven to rotate by the inner gear 4→the trigger pin 16 rotates synchronously with the outer gear 5→at this time, the trigger pin 16 does not come into contact with the load-bearing rail side 14 on the driving leg 13, such that the visor 12 is still in the fully buckled state; FIG. 34C shows that the chin guard 2 continuously returns and turns over to the vicinity of the dome of the shell body 1→the trigger pin 16 already rotates to come into contact with the load-bearing rail side 14 under the drive of the inner gear 4 and the outer gear 5→the driving leg 13 begins to act under the drive of the trigger pin 16→the visor 12 swings about the visor axis O4 and moves away from the fully buckled position→the visor 12 climbs and the return trip of the chin guard 2 during this time does not reach two-thirds of the whole return trip; FIG. 34D shows that the chin guard 2 continuously returns→the inner gear 4 continuously rotates and drives the trigger pin 16 to continuously rotate by the outer gear 5→the trigger pin 16 pushes the load-bearing rail side 14 and continuously dives the visor 12 to swing upward to the highest lifting position of the visor 12 by the load-bearing rail side 14; and, FIG. 34E shows that the chin guard 2 already returns to the full-helmet structure position, and the inner gear 4 continuously rotates and drives the trigger pin 16 to continuously rotate by the outer gear 5, but the visor 12 has already reached and stayed at the highest lifting position and the trigger pin 16 has already moved away from the load-bearing rail side 14 of the leg 13. It is to be noted that, in the embodiments of the present disclosure, for each of the two legs 13, the corresponding function can be realized by providing only one load-bearing rail side 14. Therefore, compared with CN107432520A, in the embodiments of the present disclosure, the design of the mechanism for driving the visor 12 can be greatly simplified, and the leg 13 can be simplified in design and more reasonable in structure, which can be obviously seen from the embodiments shown in FIGS. 33A through 36D (it can be seen from the drawings that the legs 13 are significantly improved in terms of thickness and structural arrangement in a load bearing direction, and the rigidity and strength of the legs 13 are also significantly improved). On the other hand, the trigger pin 16 for driving the leg 13 is more reasonable in arrangement. Firstly, the movement trajectory of the trigger pin 16 can be limited in a smaller range, thereby facilitating the compact design. Secondly, a load bearing point that the trigger pin 16 contacts and drives the load-bearing rail side 14 of the leg 13 is farther away from the visor axis O4 of the visor 12 and closer to a force application point of the locking mechanism of the visor 12. Therefore, the acting force between the trigger pin 16 and the load-bearing rail side 14 can be obviously reduced. Undoubtedly, it is beneficial for the improvement of reliability of the trigger pin 16 and the load-bearing rail side 14. In the embodiments of the present disclosure, with the above design and arrangement, during the turnover process of the chin guard 2, it can be effectively avoided that the chin guard 2 is stuck by the visor 12 or the chin guard 2 is hit by the visor 12, such that the safety and reliability of the helmet when in use are improved.

Figure 35A:
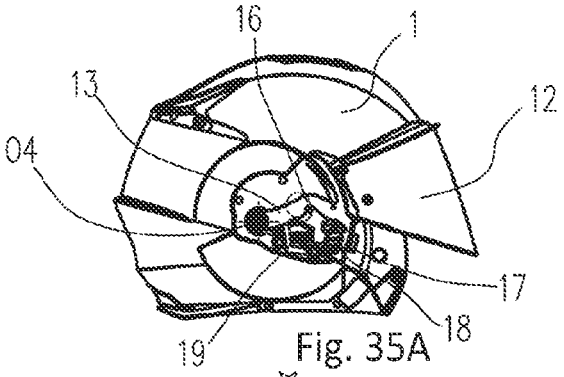
FIGS. 35A through 35D are schematic diagrams showing states changes of the helmet with the gear-constraint transformable chin guard structure according to an embodiment of the present disclosure, when the chin guard is moved from the full-helmet structure position to the semi-helmet structure position and the visor initially located at the fully buckled position is unlocked.
Figure 35B:
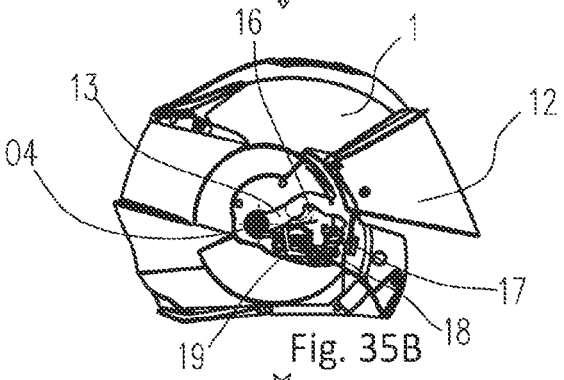
Figure 35C:
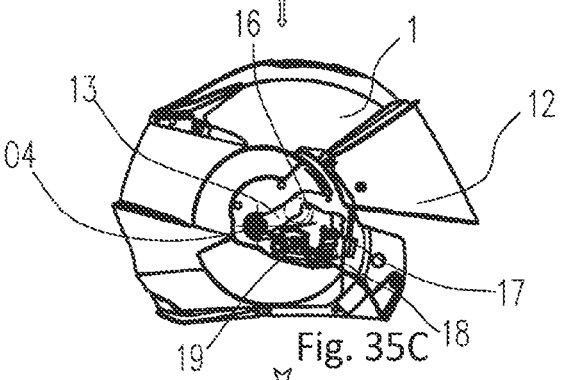
Figure 35D:
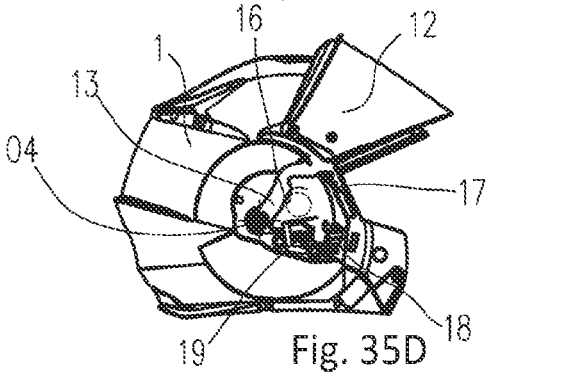
Figure 36A:
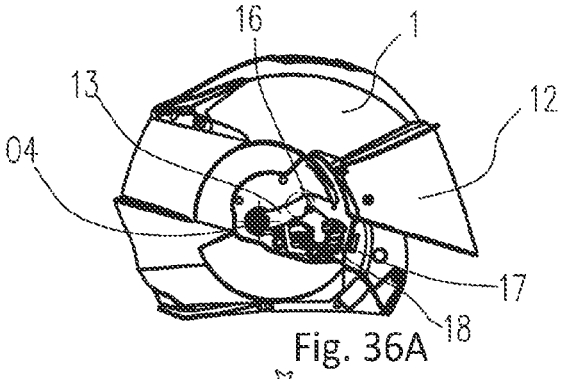
FIGS. 36A through 36D are schematic diagrams showing states changes of the helmet with the gear-constraint transformable chin guard structure according to an embodiment of the present disclosure, when the chin guard is returned from the semi-helmet structure position to the full-helmet structure position and the visor initially located at the fully buckled position is unlocked.
Figure 36B:
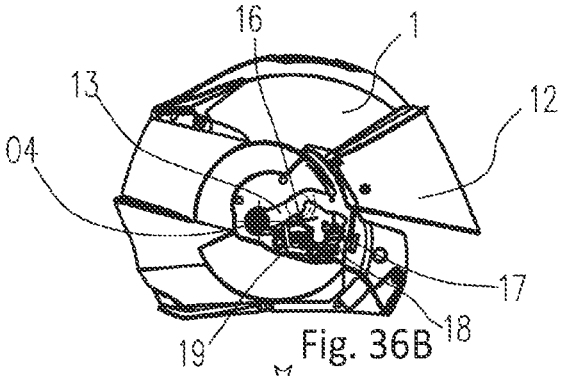
Figure 36C:
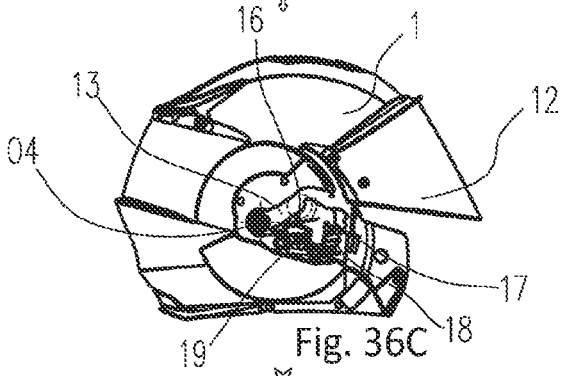
Figure 36D:
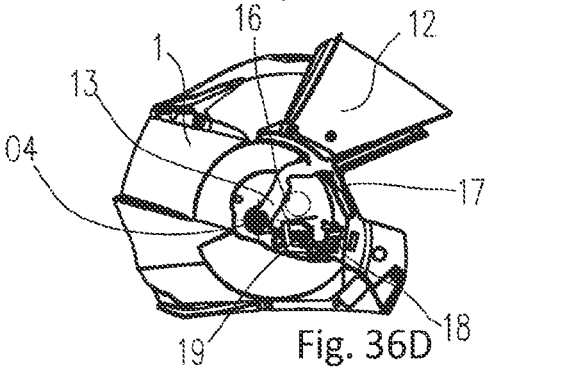

In the embodiments of the present disclosure, the following design and arrangement may be provided. Serrated first locking teeth 17 are arranged on the legs 13 of the visor 12, second locking teeth 18 corresponding to the first locking teeth 17 are arranged on the supporting base 3 or/and the shell body 1, and a locking spring 19 is arranged on the supporting base 3 or/and the shell body 1 (as shown in FIGS. 35A through 35D and 36A through 36D). The first locking teeth 17 move synchronously with the visor 12, and the second locking teeth 18 can move or swing relative to the shell body 1. When the visor 12 is in the buckled state, the second locking teeth 18 can move close to the first locking teeth 17 under the action of the locking spring 19, such that the visor 12 is weakly locked (see FIGS. 35A and 36A). When the visor 12 is opened by an external force, the first locking teeth 17 can drive and force the second locking teeth 18 to compress the locking spring 19, and the second locking teeth 18 produce a displacement to evade and unlock the first locking teeth 17 (see FIGS. 35B and 36B). FIGS. 35A through 35D illustrate the process of moving the chin guard 2 from the full-helmet structure position to the semi-helmet structure position to unlock the visor 12 which is initially located at the fully buckled position, and FIGS. 36A through 36D illustrate the process of returning the chin guard 2 from the semi-helmet structure position to the full-helmet structure position to unlock the visor 12 which is initially located at the fully buckled position. Here, it is to be noted that, in the embodiments of the present disclosure, the locking structures of the first locking teeth 17 and the second locking teeth 18 may be locked in only one pair, or may be locked in two or more pairs. In the embodiments of the present disclosure, the "unlocking" described here means that the second locking teeth 18 evade for the rotation of the first locking teeth 17 under the driving pressure generated by the rotation of the first locking teeth 17, particularly in a case of unlocking the visor 12 at the fully buckled position. In FIGS. 35A through 35D, FIG. 35A shows that the chin guard 2 is located at the full-helmet structure position and the second locking teeth 18 are locked with the first locking teeth 17 on the legs 13 of the visor 12, such that the visor 12 is locked in a fully buckled state where the wearer can be protected from outside dust, rain or the like; FIG. 35B shows that the chin guard 2 begins to turn over from the full-helmet structure position and has been slightly opened→the chin guard 2 drives the inner gear 4 at this time→the inner gear 4 drives the outer gear 5→the outer gear 5 drives the trigger pin 16→the trigger pin 16 drives the load-bearing rail side 14 on the leg 13→the leg 3 swings about the visor axis O4→the first locking teeth 17 rotate and compress the second locking teeth 18 for unlocking→the second locking teeth 18 are unlocked such that the visor 12 begins to move away from the fully buckled position and is in a slightly opened state. This state is advantageous for ventilation and dispelling vapor in the helmet by using external fresh air. It is to be noted that, FIG. 35B shows that the second locking teeth 18 have unlocked the first locking teeth 17 for the first time (that is, the visor 12 is driven to move away from the fully buckled position) and realizes second unlocking (that is, the visor 12 is allowed to stay in the slightly opened state). FIGS. 35C through 35D show that the chin guard 2 continuously moves to the semi-helmet structure position and the visor 12 is driven to a larger opened degree by the trigger pin 16, but the first locking teeth 17 are completely separated from the second locking teeth 18 at this time. In FIGS. 36A through 36D, FIG. 36A shows that the chin guard 2 is located at the semi-helmet structure position and the second locking teeth 18 are locked with the first locking teeth 17 on the legs 13, such that the visor 12 is locked in a fully buckled state where the wearer can be protected from outside dust, rain or the like; FIG. 36B shows that the chin guard 2 begins to return and turn over from the semi-helmet structure position, and during the first two-thirds of the return trip of the chin guard 2, the trigger pin 16 comes into contact with the visor 12 and drives the visor 12 to swing about a fixed axis→the first locking teeth 17 rotate and compress the second locking teeth 18 for unlocking→the second locking teeth 18 are unlocked such that the visor 12 begins to move away from the fully buckled position and is in a slightly opened state; and, FIGS. 36C and 36D show that the chin guard 2 continuously returns to the full-helmet structure position and the visor 12 is driven to a larger opened degree by the trigger pin 16, but the first locking teeth 17 are completely separated from the second locking teeth 18 at this time. Here, in the embodiments of the present disclosure, the weak locking means that the visor 12 can stay at the locked position (i.e., in the buckled state) if the visor 12 is not driven intentionally; and, when the helmet wearer forcibly pulls the visor 12 with hands or forcibly drives the chin guard 2 such that the trigger pin 16 on the outer gear 5 forcibly drives the load-bearing rail side 14 on the leg 13 of the visor 12, the visor 12 can still be unlocked and opened.

Compared with the existing technologies, the embodiments of the present disclosure have the following remarkable advantages. By using the arrangement mode of forming an associated mechanism by the chin guard 2, the inner gear 4, the outer gear 5 and the drive member 7, the inner gear 4 and the outer gear 5 are allowed to be rotatable and meshed with each other to constitute a kinematic pair, and a constraint pair in sliding fit with the branch 2*a* of the chin guard 2 is constituted on the inner gear 4, such that the branch 2*a*, the inner gear 4 and the outer gear 5 can be driven by each other to rotate; meanwhile, the branch 2*a* is driven to produce a reciprocating displacement relative to the inner gear 4 by the drive member 7 connected to the outer gear 5 and the branch 2*a* of the chin guard 2, such that the position and posture of the chin guard 2 can be accurately changed along with the action of opening or closing the chin guard 2. Accordingly, the transformation of the chin guard 2 between the full-helmet structure position and the semi-helmet structure position is realized, and the uniqueness and reversibility of the geometric motion trajectory of the chin guard 2 can be maintained. According to the embodiments of the present disclosure, based on the arrangement mode and operation mode of the associated mechanism, during the pose transform process of the chin guard 2, the body of the branch 2*a* of the chin guard 2 can be rotated synchronously with the inner gear 4, so as to basically or even completely cover the through slot 6 in the inner gear 4. Thus, external foreign matters can be prevented from entering the constraint pair, and the reliability of the helmet when in use is ensured. Moreover, the path of external noise entering the inside of the helmet can be blocked, and the comfort of the helmet when in use is improved. Meanwhile, since the operation space occupied by the outer gear that rotates about a fixed axis is relatively small, a more flexible arrangement choice is provided for the fastening structure of the supporting base 3, the support rigidity of the supporting base 3 can be improved, thereby the overall safety of the helmet can be further improved.

The foregoing embodiments are merely several preferred embodiments of the present disclosure, and are not intended to limit the protection scope of the present disclosure. Therefore, various equivalent variations made according to the structures, shapes and principles of the present disclosure shall fall into the protection scope of the present disclosure.

What is claimed is:

1. A helmet with a gear-constraint transformable chin guard structure, comprising:

a shell body;

a chin guard; and two supporting bases, wherein the two supporting bases are arranged on two sides of the shell body, respectively, and the two supporting bases are fastened on the shell body or integrated with the shell body;

wherein the chin guard is provided with two branches which are arranged on two sides of the shell body, respectively;

wherein for each of the two supporting bases, an inner gear constrained by the supporting base and/or the shell body and an outer gear constrained by the supporting base and/or the shell body are provided;

wherein the inner gear is rotatable about an axis of the inner gear, and the outer gear is rotatable about an axis of the outer gear;

wherein the inner gear comprises a body or an attachment having a through slot, and a drive member running through the through slot is provided;

wherein the supporting base, the branch, the inner gear, the outer gear and the drive member on a side of the shell body constitute an associated mechanism;

wherein in the associated mechanism, the branch is arranged outside the through slot of the inner gear, the outer gear and the inner gear are meshed with each other to constitute a kinematic pair, and the inner gear is in sliding fit with the branch to constitute a slidable kinematic pair;

wherein the drive member is connected to the outer gear at one end of the drive member, such that the drive member is able to be driven by the outer gear or the outer gear is able to be driven by the drive member; the drive member is connected to the branch at the other end of the drive member, such that the branch is able to be driven by the drive member or the drive member is able to be driven by the branch, wherein in at least one associated mechanism, a ratio of an inner-gear full-circumference equivalent teeth number ZR of meshing elements comprised in the inner gear to an outer-gear full-circumference equivalent teeth number Zr of meshing elements comprised in the outer gear satisfies a relationship: ZR/Zr=2.

2. The helmet with the gear-constraint transformable chin guard structure according to claim 1, wherein in the associated mechanism, the kinematic pair constituted by the inner gear and the outer gear is a planar gear drive mechanism.

3. The helmet with the gear-constraint transformable chin guard structure according to claim 2, wherein in the associated mechanism, the inner gear and the outer gear are cylindrical gears; and, when the inner gear and the outer gear are meshed with each other, a pitch radius R of the inner gear and a pitch radius r of the outer gear satisfy a relationship: $R/r=2$.

4. The helmet with the gear-constraint transformable chin guard structure according to claim 3, wherein in the associated mechanism, the drive member comprises a revolution surface having a revolution axis, the revolution axis is always rotatable about an outer gear axis synchronously along with the outer gear, and the revolution axis is arranged parallel to the outer gear axis and intersects with a pitch circle of the outer gear.

5. The helmet with the gear-constraint transformable chin guard structure according to claim 4, wherein the revolution surface of the drive member is a cylindrical surface structure or a circular conical surface.

6. The helmet with the gear-constraint transformable chin guard structure according to claim 5, wherein, the drive member is fastened to the outer gear or integrated with the outer gear, and the drive member is in rotatable fit with the branch; or the drive member is in rotatable fit with the outer gear, and the drive member is fastened to the branch or integrated with the branch; or the drive member is in rotatable fit with the outer gear, and the drive member is also in rotatable fit with the branch.

7. The helmet with the gear-constraint transformable chin guard structure according to claim 6, wherein a first anti-disengagement member capable of preventing axial endplay of the inner gear is arranged on the supporting base, the shell body and/or the outer gear; a second anti-disengagement member capable of preventing axial endplay of the outer gear is arranged on the inner gear, the supporting base and/or the shell body; and, a third anti-disengagement member capable of preventing axial loosening of the branch of the chin guard is arranged on the inner gear.

8. The helmet with the gear-constraint transformable chin guard structure according to claim 7, wherein at least one of gear teeth of the outer gear is designed as an abnormity gear tooth having a thickness greater than an average thickness of all effective gear teeth on the outer gear, and the drive member is only connected to the abnormity gear tooth.

9. The helmet with the gear-constraint transformable chin guard structure according to claim 8, wherein the through slot of the inner gear is a flat straight through slot which is arranged to point to or pass through an inner gear axis; the slidable kinematic pair constituted by slidable fitting of the inner gear with the branch is a linear slidable kinematic pair, and the linear slidable kinematic pair is arranged to point to or pass through the inner gear axis; and, the straight through slot and the linear slidable kinematic pair are overlapped with each other or parallel to each other.

10. The helmet with the gear-constraint transformable chin guard structure according to claim 9, wherein when the chin guard is at a full-helmet structure position, the revolution axis of the revolution surface of the drive member in at least one associated mechanism is overlapped with the inner gear axis, and linear constraint elements comprised in the slidable kinematic pair in the associated mechanism are perpendicular to a plane constituted by the inner gear axis and the outer gear axis.

11. The helmet with the gear-constraint transformable chin guard structure according to claim 10, wherein a central angle $\alpha$ covered by all effective gear teeth on the inner gear is greater than or equal to 180 degrees.

12. The helmet with the gear-constraint transformable chin guard structure according to claim 11, wherein a first clamping structure is arranged on the supporting base and/or the shell body; at least one second clamping structure is arranged on the body of the inner gear or an extension of the inner gear; an acting spring for pressing and driving the first clamping structure close to the second clamping structure is further arranged on the supporting base and/or the shell body; the first clamping structure and the second clamping structure are male and female catching structures matched with each other; and, when the first clamping structure and the second clamping structure are clamp-fitted with each other, an effect of clamping and keeping the chin guard at a present position and posture of the chin guard is able to be achieved.

13. The helmet with the gear-constraint transformable chin guard structure according to claim 12, wherein the first clamping structure is in a convex tooth configuration; the second clamping structure is in a groove configuration; at least one second clamping structures is provided, wherein a second clamping structure is clamp-fitted with the first clamping structure when the chin guard is at a full-helmet structure position and another second clamping structure is clamp-fitted with the first clamping structure when the chin guard is at a semi-helmet structure position.

14. The helmet with the gear-constraint transformable chin guard structure according to claim 13, wherein, another second clamping structure is clamp-fitted with the first clamping structure when the chin guard is at a face-uncovered structure position.

15. The helmet with the gear-constraint transformable chin guard structure according to claim 14, wherein the shell body comprises a booster spring arranging on the supporting base and/or the shell body; when the chin guard is at the full-helmet structure position, the booster spring is compressed and stores energy; when the chin guard turns over from the full-helmet structure position to a dome of the shell body, the booster spring releases the elastic force to aid in opening the chin guard; and, when the chin guard is located between the full-helmet structure position and the face-uncovered structure position, the booster spring stops acting on the chin guard.

16. The helmet with the gear-constraint transformable chin guard structure according to claim 1, wherein the outer gear in at least one associated mechanism comprises a web plate arranging on the outer gear.

17. The helmet with the gear-constraint transformable chin guard structure according to claim 1, wherein in at least one associated mechanism, the inner gear comprises a through slot constituted in the inner gear, the through slot participates in the slidable constraint behavior of the inner gear and the branch, and the slidable constraint behavior constitutes a part or all of the slidable kinematic pair constituted by the inner gear and the branch.

18. The helmet with the gear-constraint transformable chin guard structure according to claim 1, further comprising a visor, wherein the visor comprises two legs arranged on two sides of the shell body, respectively, and capable of swinging around a fixed axis relative to the shell body; a load-bearing rail side is arranged on at least one of the legs, and the leg with the load-bearing rail side is arranged between the supporting base and the shell body; a through opening is constituted in an inner supporting plate on the supporting base facing the shell body, and a trigger pin extending out of the opening and capable of coming into contact with the load-bearing rail side of the leg is arranged on the outer gear; and, when the visor is in a fully buckled state, the arrangement of the trigger pin and the load-bearing rail side satisfies several conditions: when the chin guard is opened from the full-helmet structure position, the trigger pin is able to come into contact with the load-bearing rail side on the leg and thereby drive the visor to turn over; and when the chin guard returns to the full-helmet structure position from the semi-helmet structure position, during the first two-thirds of the return trip of the chin guard, the trigger pin is able to come into contact with the load-bearing rail side on the leg and thereby drive the visor to turn over.

19. The helmet with the gear-constraint transformable chin guard structure according to claim 18, wherein serrated first locking teeth are arranged on the legs of the visor, and second locking teeth corresponding to the first locking teeth are arranged on the supporting base and/or the shell body; a locking spring is arranged on the supporting base and/or the shell body; the first locking teeth move synchronously with the visor, and the second locking teeth is able to move or swing relative to the shell body; when the visor is in a buckled state, the second locking teeth is able to move close to the first locking teeth under the action of the locking spring, such that the visor is weakly locked; and, when the visor is opened by an external force, the first locking teeth is able to forcibly drive the second locking teeth to compress the locking spring to displace and thereby give way to the first locking teeth and unlock the first locking teeth.

20. A helmet with a gear-constraint transformable chin guard structure, comprising:

a shell body;

a chin guard; and two supporting bases, wherein the two supporting bases are arranged on two sides of the shell body, respectively, and the two supporting bases are fastened on the shell body or integrated with the shell body;

wherein the chin guard is provided with two branches which are arranged on two sides of the shell body, respectively;

wherein for each of the two supporting bases, an inner gear constrained by the supporting base and/or the shell body and an outer gear constrained by the supporting base and/or the shell body are provided;

wherein the inner gear is rotatable about an axis of the inner gear, and the outer gear is rotatable about an axis of the outer gear;

wherein the inner gear comprises a body or an attachment having a through slot, and a drive member running through the through slot is provided;

wherein the supporting base, the branch, the inner gear, the outer gear and the drive member on a side of the shell body constitute an associated mechanism;

wherein in the associated mechanism, the branch is arranged outside the through slot of the inner gear, the outer gear and the inner gear are meshed with each other to constitute a kinematic pair, and the inner gear is in sliding fit with the branch to constitute a slidable kinematic pair;

wherein the drive member is connected to the outer gear at one end of the drive member, such that the drive member is able to be driven by the outer gear or the outer gear is able to be driven by the drive member; the drive member is connected to the branch at the other end of the drive member, such that the branch is able to be driven by the drive member or the drive member is able to be driven by the branch;

wherein in the associated mechanism, the kinematic pair constituted by the inner gear and the outer gear is a planar gear drive mechanism; and wherein in the associated mechanism, the inner gear and the outer gear are cylindrical gears; and, when the inner gear and the outer gear are meshed with each other, a pitch radius R of the inner gear and a pitch radius r of the outer gear satisfy a relationship: $R/r=2$.

21. A helmet with a gear-constraint transformable chin guard structure, comprising:

a shell body;

a chin guard; and two supporting bases, wherein the two supporting bases are arranged on two sides of the shell body, respectively, and the two supporting bases are fastened on the shell body or integrated with the shell body;

wherein the chin guard is provided with two branches which are arranged on two sides of the shell body, respectively;

wherein for each of the two supporting bases, an inner gear constrained by the supporting base and/or the shell body and an outer gear constrained by the supporting base and/or the shell body are provided;

wherein the inner gear is rotatable about an axis of the inner gear, and the outer gear is rotatable about an axis of the outer gear;

wherein the inner gear comprises a body or an attachment having a through slot, and a drive member running through the through slot is provided;

wherein the supporting base, the branch, the inner gear, the outer gear and the drive member on a side of the shell body constitute an associated mechanism;

wherein in the associated mechanism, the branch is arranged outside the through slot of the inner gear, the outer gear and the inner gear are meshed with each other to constitute a kinematic pair, and the inner gear is in sliding fit with the branch to constitute a slidable kinematic pair;

wherein the drive member is connected to the outer gear at one end of the drive member, such that the drive member is able to be driven by the outer gear or the outer gear is able to be driven by the drive member; the drive member is connected to the branch at the other end of the drive member, such that the branch is able to be driven by the drive member or the drive member is able to be driven by the branch; and further comprising a visor, wherein the visor comprises two legs arranged on two sides of the shell body, respectively, and capable of swinging around a fixed axis relative to the shell body; a load-bearing rail side is arranged on at least one of the legs, and the leg with the load-bearing rail side is arranged between the supporting base and the shell body; a through opening is constituted in an inner supporting plate on the supporting base facing the shell body, and a trigger pin extending out of the opening and capable of coming into contact with the load-bearing rail side of the leg is arranged on the outer gear; and, when the visor is in a fully buckled state, the arrangement of the trigger pin and the load-bearing rail side satisfies several conditions: when the chin guard is opened from the full-helmet structure position, the trigger pin is able to come into contact with the load-bearing rail side on the leg and thereby drive the visor to turn over; and when the chin guard returns to the full-helmet structure position from the semi-helmet structure position, during the first two-thirds of the return trip of the chin guard, the trigger pin is able to come into contact with the load-bearing rail side on the leg and thereby drive the visor to turn over.

* * * * *